US006886848B2

(12) United States Patent
Riepler

(10) Patent No.: US 6,886,848 B2
(45) Date of Patent: May 3, 2005

(54) SKI OR SNOWBOARD

(75) Inventor: Bernhard Riepler, Wagrain (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 99 days.

(21) Appl. No.: 10/168,512

(22) PCT Filed: Dec. 14, 2000

(86) PCT No.: PCT/AT00/00342

§ 371 (c)(1),
(2), (4) Date: Oct. 1, 2002

(87) PCT Pub. No.: WO01/45811

PCT Pub. Date: Jun. 28, 2001

(65) Prior Publication Data

US 2003/0111824 A1 Jun. 19, 2003

(30) Foreign Application Priority Data

Dec. 22, 1999 (AT) ..... 2157/99

(51) Int. Cl.[7] ..... A63C 5/04
(52) U.S. Cl. ..... 280/602; 280/609; 280/610
(58) Field of Search ..... 280/601, 602, 280/607, 609, 610

(56) References Cited

U.S. PATENT DOCUMENTS

| | | | | | |
|---|---|---|---|---|---|
| 2,377,504 | A | * | 6/1945 | Basil | 280/601 |
| 3,940,157 | A | * | 2/1976 | Sakuma | 280/610 |
| 4,071,264 | A | * | 1/1978 | Legrand et al. | 280/610 |
| 4,545,597 | A | * | 10/1985 | Meatto et al. | 280/610 |
| 4,681,725 | A | * | 7/1987 | Maruyama | 264/46.5 |
| 4,902,548 | A | * | 2/1990 | Cholat-Serpoud et al. | 428/102 |
| 4,911,462 | A | * | 3/1990 | Diard et al. | 280/607 |
| 5,000,475 | A | * | 3/1991 | Gagneux et al. | 280/602 |
| 5,002,301 | A | * | 3/1991 | Cagneux et al. | 280/602 |
| 5,141,243 | A | * | 8/1992 | Meatto | 280/602 |
| 5,339,545 | A | * | 8/1994 | Paris | 36/117.6 |
| 5,366,234 | A | * | 11/1994 | Rohrmoser | 280/610 |
| 5,393,085 | A | * | 2/1995 | Forneri | 280/602 |
| 5,427,401 | A | * | 6/1995 | Liard | 280/609 |
| 5,445,403 | A | * | 8/1995 | Cazaillon et al. | 280/610 |
| 5,498,016 | A | * | 3/1996 | Jodelet | 280/602 |
| 5,573,264 | A | * | 11/1996 | Deville et al. | 280/602 |
| 5,695,209 | A | * | 12/1997 | Deborde et al. | 280/610 |
| D418,545 | S | * | 1/2000 | Cassel | D21/766 |

FOREIGN PATENT DOCUMENTS

| | | |
|---|---|---|
| AT | 16 460 | 3/1986 |
| DE | 44 95 484 | 5/1997 |
| EP | 0 081 834 | 6/1983 |

* cited by examiner

*Primary Examiner*—Christopher P. Ellis
*Assistant Examiner*—Christopher Bottorff
(74) *Attorney, Agent, or Firm*—Collard & Roe, P.C.

(57) ABSTRACT

The invention relates to a board-type runner device (1), in particular a ski (2) or a snowboard, comprising several layers disposed between a running surface lining (25) and a top layer (24), with a top belt (31) lying closest to the top layer (24) and/or a bottom belt (32) lying closest to the running surface lining (25) of a highly tensile material. In conjunction with a core disposed between the layers, these layers form a multi-layered element and at least one profiled section (12, 13) is provided in the core. At least a part-region of the outer surface of the profiled section (12, 13) is embedded or inlaid in a layer (44, 45) of an elastic synthetic material, preferably a layer (44, 45) of expanded synthetic material above the profiled section (12, 13) that is flexible and elastically resilient under the action of forces.

23 Claims, 13 Drawing Sheets

SKI OR SNOWBOARD

CROSS REFERENCE TO RELATED APPLICATIONS

Applicant claims priority under 35 U.S.C. §119 OF Austrian Application No. A 2157/99 filed Dec. 22, 1999. Applicant also claims priority under 35 U.S.C. §365 of PCT/AT00/00342 filed Dec. 14, 2000. The international application under PCT article 21 (2) was not published in English.

BACKGROUND OF THE INVENTION

1. Field of the Invention

The invention relates to a ski or snowboard.

2. Description of the Prior Art

Patent specification DE 44 95 484 C1 discloses a ski body comprising a plurality of moulded elements and layers arranged adjacent to and/or on top of one another, which are adhesively or positively joined to one another. One of the strip-shaped layers has recesses and mounds channelled into it and essentially extends across the entire width and length of the ski body. Disposed between the contoured layer shaped from a flat board material and the profiled, moulded elements arranged underneath is a damping layer made from an elastomeric material, which also extends across a major part of the width and length of the ski body. An alternative suggestion is that the profiled, moulded elements be provided in the form of tubes. As illustrated in the drawings, a hard, dimensionally stable filler is also provided between the elastomeric damping layer and the contoured layers in the standard way used to manufacture a ski body, whereby a layer fulfilling a bearing function is inserted in the ski body between the elastically flexible damping layer and the layer disposed above it assuming a bearing function, depending on the structure. The purpose of this dimensionally stable filler is primarily to fill the recesses on the top face of the moulded layer. Accordingly, the elastomeric damping layer and the bearing layers of the ski body do not come into contact with it for the most part. The shearing forces which occur when the ski is flexed, in particular between the top as well as the bottom layer of the damping layer and the adjoining parts or layers of the ski body, must be efficiently absorbed, primarily by the broadly extending elastomeric damping layer, and high demands are therefore placed on the means intended to transmit the shearing forces, in particular the adhesive and filler materials, and on the damping layer itself, to ensure that layers of the ski body do not come apart. Over a longer period of time and under extreme stress, however, the elastomeric intermediate layer in the ski body constitutes a critical weak point in terms of preserving the intended properties and with regard to the integrity of the multi-layered element as a whole, given that it represents an extensive dividing or transition region in the ski body that is exposed to a high degree of stress.

Patent specification EP 0 081 834 B1 and the corresponding patent AT 16 460 E proposes a ski with a core made from injected or moulded synthetic material. This ski core is made from a porous, injected or moulded synthetic material, such as expanded polyurethane, for example. Due to the fact that this porous core material is relatively heavy, it is proposed that a cavity should be left free in the corresponding core material in order to reduce weight. This is achieved by injecting the relatively heavy synthetic material around a hollow, tubular component, which saves on the synthetic material used for the ski core. It is further suggested that the ends of the tube should be closed to prevent the expanded and then cured synthetic material from penetrating the interior of the tube. Although the cavities in the ski core enable the weight of the ski to be reduced, they do not produce any significant improvements in running properties.

The underlying objective of the present invention is to propose a board-type device, in particular a ski or a snowboard, with dynamic but tolerant running properties, by means of which the forces generated on an integrated damping layer can be reliably absorbed when the runner device is deformed.

SUMMARY OF THE INVENTION

This objective is achieved by the invention with a ski or snowboard comprising several layers disposed between a running surface lining and a top layer, including a top belt of a high-tensile material laying closest to the top layer and a bottom belt of a high-tensile material laying closest to the running surface lining. The layers form a multi-layer element with at least one profiled section disposed between the top belt and the bottom belt. At least a part-region of the outer surface of the at least one profiled section is embedded in a layer of an elastic synthetic material that is flexible and elastically resilient relative to the at least one profiled section under pressure. A top face of the ski or snowboard opposite the running surface lining has a contour consisting of at least one raised area and recess, the cross-sectional shape or dimension of the at least one profiled section at least approximately conforming to the at least one raised area and recess of the top face contour, and the cross-sectional shape or dimension being a factor determining the top face contour. Such a ski or snowboard has surprisingly good running properties because it has significantly more tolerance but still exhibits a high degree of agility and dynamics. This effect is primarily achieved as a result of the almost elastic bearing and the profiled section embedded in the elastic expanded synthetic material, whereby the layer formed at least above and beneath the moulded contour is more flexible and elastically compressible than the inherently stable profiled section. The multi-layered element has a high degree of cohesion, in spite of the fact that the inherently rigid profiled section is embedded in the relatively elastic material, because the elastic inlay for the profiled section is provided in only part of the region surrounding the profiled section and high-strength adhesives and fillers can be provided in the peripheral regions thereof to guarantee the integrity of the multi-layered element. Elastically embedding at least one profiled section means that a flexural element is integrated in the runner body, which is crucial to the running properties of the runner device. Furthermore, with a ski or snowboard of this construction, exact adjustments can easily be made to the values needed to obtain a runner device with almost ideal characteristics.

Relatively large-volume profiled sections may be used, which can be adapted within a relatively broad range of characteristics to obtain ideal or desired values in terms of bending moment, torsional strength, rebound behaviour and similar. Another significant advantage is the fact that the surface contour or surface profiling of the finished ski or snowboard can be supported by the underlying profiled sections, enabling potential savings to be made in terms of the thickness of the layer used for the too belt and/or the bottom belt. Profiled sections with a relatively large cross-sectional surface area can be integrated without problem, further imparting a positive overall visual impression to the ski or snowboard.

It is also of advantage if the layer of elastic synthetic material retains the at least one profiled section on all sides and is comprised of an elastomeric, expanded synthetic material having a density of 200 ka/cu.m to 400 ka/cu.m. because a relatively elastic expanded synthetic material can be used without problem to make the core of the ski or snowboard, and without going below the compression strength needed for the runner device, because the integrated profiled sections act to a certain degree as spacing elements between the top layers and bottom layers and between the top belt and bottom belt of the runner device, whilst at the same time enabling at least one profiled section to be advantageously embedded in a sufficiently elastic arrangement.

Polyurethane foam is easy to process and produces the sought elastomeric effects.

If the at least part-region of the outer surface of the at least one profiled section runs close to the bottom or too belt, the layer of elastic synthetic material being disposed in between, a core is produced in which elasticity is limited as the deformation and compression strength progressively increases.

The at least part-region of the outer surface of the at least one profiled section may be supported on an internal surface of an outer profiled section at least partially enclosing the at least one profiled section, and the layer of elastic synthetic material is inlaid therebetween. The resultant multi-layered component is made up of two relatively hard layers or shell parts with a permanently elastic layer disposed in between, which is easy to pre-fabricate separately and can then be perfectly easily assembled with the other surrounding plies or layers of the runner device to make up the overall runner device.

A core component with the requisite elasticity and bending strength, which is easy to produce, and facilitates the process of producing the ski or snowboard is obtained if the at least one profiled section and the layer of elastic synthetic material forms a multi-layered core of the multi-layer element, the multi-layered core being capable of being pre-fabricated.

If the profiled section is hollow or tubular, a generally standard profiled section can be used, which is easy to manufacture, thereby enabling the total cost of producing the runner device to be reduced.

If the outer profiled section has a U-shaped, V-shaped or dish-shaped cross-section and encloses at least an upper outer surface region of the at least one profiled section disposed therebelow, primary deformational stress in the middle region of the runner device in a vertical downward direction is counteracted by a section modulus that is higher than the relatively lower flexural stress of the runner device in an upward vertical direction.

A particularly compact, multi-layered bending and damping element for the ski or snowboard can be readily incorporated in a process for manufacturing the same if the at least one profiled section is received in an outer profiled section, with the elastic synthetic material layer arranged therebetween.

If the at least one profiled section directly abuts an underside of the top belt and is spaced apart by the layer of elastic synthetic material from the bottom belt and lower layers of the multi-layer element, only a slight inverse torque is generated by the profiled section during the initial phase of a flexing motion of the ski or snowboard and a sufficient damping path is afforded due to the relatively generous thickness of the elastic layer, without the need for any deformation of the profiled section. The profiled section is not deformed until the flexing motion becomes more pronounced, at which point the latter generates a progressively increasing inverse torque.

Optimized account of the stress acting on the profiled section is taken if the at least one profiled section decreases in height from a mid-region of the ski or snowboard to the ends thereof, the mid-region forming a mounting region for a binding.

Another profiled section of elliptical cross-section has a relatively simple structure which makes the best possible use of the available core region and is easy to manufacture.

It is particularly advantageous if one of the profiled sections extends continuously into spaced-apart regions of contact of an underside of the ski or snowboard with a level underlying around when no load is applied thereto, and the other profiled section is shorter than the one profiled section. A continuous core element extending in a bridge-type arrangement is advantageously obtained, in which the load-transmitting points and the end regions of the profiled sections extend as far as the outermost contact and bearing regions of the ski or snowboard with the ground. Consequently, it does not have any weak points or points that are susceptible to breakage in the end region of the profiled sections, which are inherently stable, relatively speaking, obtaining a harmonious bending characteristic over wide regions of the ski or snowboard.

The at least one profiled section preferably extends beyond the ends of the outer profiled section to the regions of contact, and the at least one profiled section is completely uncoupled from the outer profiled section. This takes account of the relatively limited space availability in the end regions of the sports device.

A damping action directed in the longitudinal direction of the runner device and the profiled section is obtained if the outer tubular profiled section is flattened at the ends thereof, and the at least one profiled section is shorter than the outer tubular profiled section and is embedded in the layer of elastic synthetic material, and damping layers can be provided which are specifically adapted to the quite pronounced relative movements between the front ends of the outer and inner profiled section.

Any direct contact between the hard layers of the profiled sections nested one inside the other is avoided and also the weight of the ski or snowboard is reduced if the layer of elastic synthetic material is a spacing web spacing the at least one profiled section apart from the outer profiled section, the profiled sections defining at least one cavity therebetween.

The at least one profiled section may be mounted so that it vibrates freely relative to the outer profiled section, imparting an intermittently or sharply rising characteristic to the bending moment of the unit of profiled sections and the ski or snowboard as a whole if the spacing web is so aligned that the cavity is formed above or below the at least one profiled section bounded by the outer profiled section.

The profiled sections are prevented from coming into direct contact during extreme deformation of the runner device if the spacing web is aligned vertically between the at least one profiled section and the outer profiled section and is so dimensioned that the cavity is formed in at least one of two side regions between the profiled sections.

The profiled sections may be individually adapted to requirements and space availability if the cross-sectional width of the at least one profiled section is approximately 10% to 40% of the width of the ski or snowboard.

The ski or snowboard as a whole exhibits good cohesion and the individual layers adjacent to the elastic layer are securely prevented from coming apart if the transverse extension of the layer of elastic synthetic material is approximately 10% to 40% of the width of the ski or snowboard.

BRIEF DESCRIPTION OF THE DRAWING

The invention will be described in more detail below with reference to examples of embodiments illustrated in the appended drawings.

Of these.

DETAILED DESCRIPTION OF THE PREFERRED EMBODIMENTS

Figure 1:
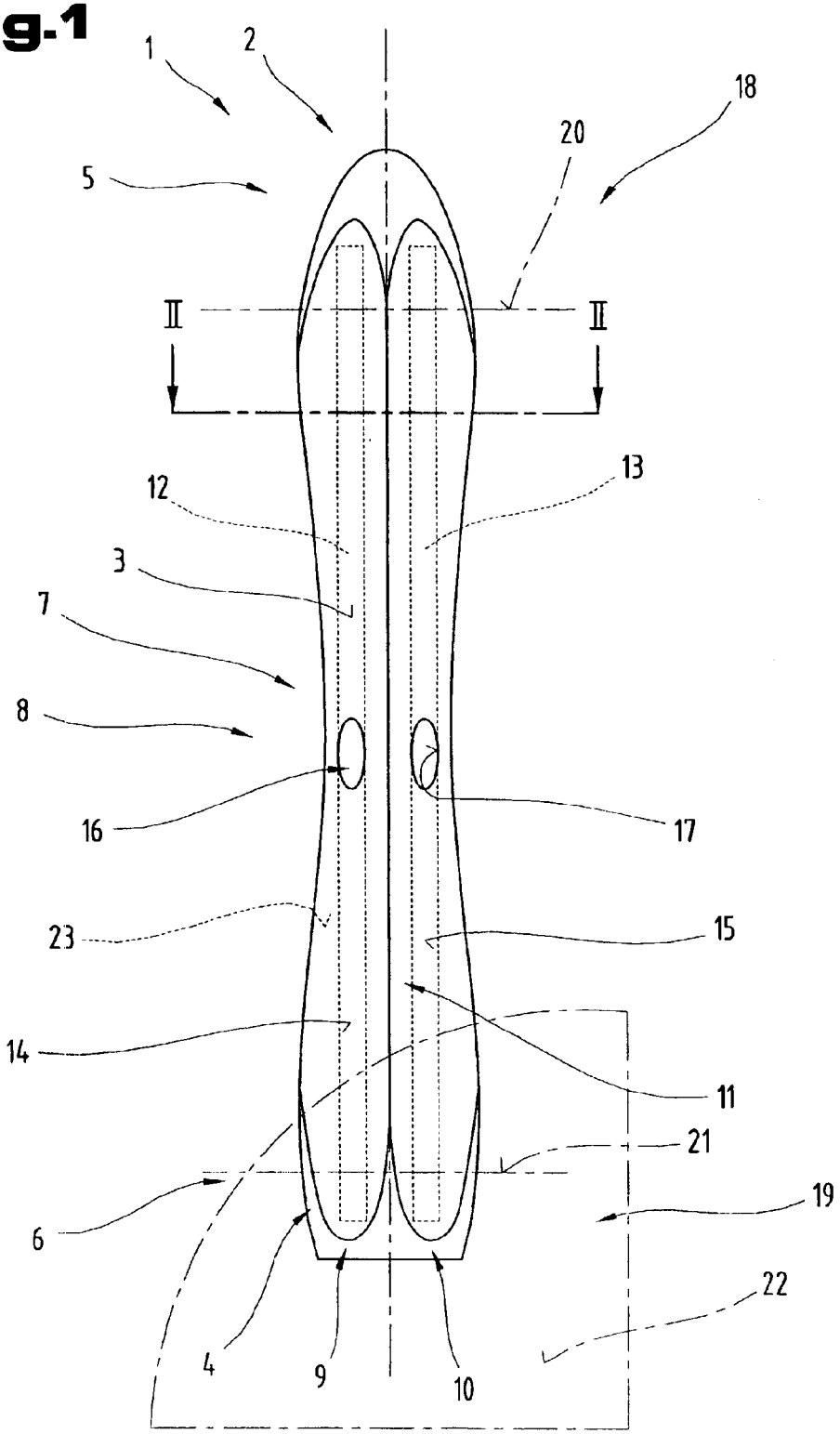
FIG. 1 is a simplified diagram, not shown to scale, in plan view, of a runner device with a contoured top face as proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 provides a plan view of a runner device 1 designed and constructed as proposed by the invention. This runner device 1 may be a ski 2 or alternatively a snowboard, depending on the selected ratio of length to width. The ratio of length to width of a ski 2 will essentially be larger than that of a so-called snowboard.

A top face 3 of the runner device 1 as seen in a plan view or from the position of usage, is preferably of a profiled or contoured design. This contouring 4 extends without interruption along almost the entire length as far as the vicinity of the end regions 5, 6 of the runner device 1. Optionally, the contouring 4 may also extend in a mid-region 7 of the runner device 1 and in a binding mounting region 8 thereof or may merge into a level mid-region 7 serving as a mounting platform for an appropriate binding. Starting from a mid-region 7, which may be of a level, plateau-type design, the contouring 4 in any event runs along the top face 3 of the runner device 1 until close up to the end regions 5, 6. The contouring 4 in the mid-region 7 and in the zones adjoining the binding mounting region 8 is more pronounced than in the end regions 5, 6 of the runner device 1. In particular, the contouring 4 runs gradually outwards, the closer it gets to the two end regions 5, 6 of the runner device 1. In other words, the contouring 5 becomes constantly flatter, the closer it is to the end regions 5, 6 and finally merges into flat end regions 5, 6. Accordingly, at least one so-called tip is formed in the end regions 5, 6 of the runner device 1.

The contouring 4 on the top face 3 is provided in the form of at least one, preferably two, bead-type mounds 9, 10 running substantially parallel with one another. Another alternative is to provide three or more such mounds 9, 10 extending in the longitudinal direction of the runner device 1.

A more or less pronounced recess 11 is formed between two mounds 9, 10 extending in the longitudinal direction of the runner device 1 and runs between the mounds 9, 10. The base or bottom of the recess 11 may be substantially V-shaped or alternatively U-shaped in cross section, i.e. has a largely flattened, level base region. Instead of providing a bead-type contouring 4 with at least one arcuately shaped raised area on the top face 3 of the runner device 1 as viewed transversely to the longitudinal direction, it would naturally be possible to provide a different type of contouring 4. For example, the bead-typed mounds 9, 10 could be flatter in the region of the upper peak, in which case the mounds 9, 10 would be trapezoidal in cross-sectional shape. Similarly, the layout of recess and mounds 9, 10 could be reversed, in which case a bead-type mound would run in the mid-region of the runner device 1 with two recesses channelled into the top face 3 of the runner device 1 on either side of the bead-type mounds.

The multi-layered body of the runner device 1 contains at least one profiled section 12, 13. By preference, a profiled section 12, 13 is provided for every mound 9, 10 and every raised area 14, 15. The profiled sections 12, 13 are preferably fully integrated in the runner device 1, i.e. enclosed on all sides by the other structural components of the runner device 1.

Optionally, the profiled section 12, 13 may also be arranged extending out from the multi-layered body or sandwich element in the mid-region 7 and binding mounting region 8 or alternatively in the zones adjoining the binding mounting region 8. To this end, the profiled sections 12, 13 may run close to the top face 3 of the runner device 1 and be at least partially visible by means of transparent part-regions in the form of viewing windows 16 or cut-out regions 17 in the top face 3 of the runner device 1.

A longitudinal extension of the contouring 4 on the top face 3 of the runner device 1 is only slightly longer than a longitudinal extension of the integrated profiled sections 12, 13. In other words, a length of the profiled sections 12, 13 is only slightly shorter than the longitudinal extension of the contouring 4. The lengthwise dimensions of the integrated profiled sections 12, 13 are therefore a contributing factor to the extent of the longitudinal contouring 4 on the top face 3.

By preference, the profiled sections 12, 13 extend continuously between a front contact zone 18 and a rear contact zone 19 of the runner device 1 when the board-type runner device 1 is placed on level ground with no load. When the runner device 1 is in the no-load state, these contact zones 18, 19 and the resultant contact points 20, 21 of the runner device 1 on underlying ground 22 occur exclusively in the end regions 5, 6 thereof.

When in the unloaded state and under its own natural weight, the mid-region 7 of the runner device 1 does not sit on the underlying ground 22 due to its so-called pre-tensioning. This is caused by the so-called pre-tensioned height of the runner device 1, defined by the longest distance between a running surface 23 of the runner device 1 and a flat contact surface under the effect of the natural weight of the runner device 1. Exposed to natural forces or in the non-operating state, the runner device 1 curves upwards in an arc between its contact points 20, 21. This camber or pre-tensioning of the runner device 1 is determined amongst other things by the continuous profiled section 12, 13, which extends in a cambered or bridge-type arrangement between the end regions 5, 6 and between the contact points 20, 21 of the runner device 1, as will be explained in more detail below.

Figure 2:
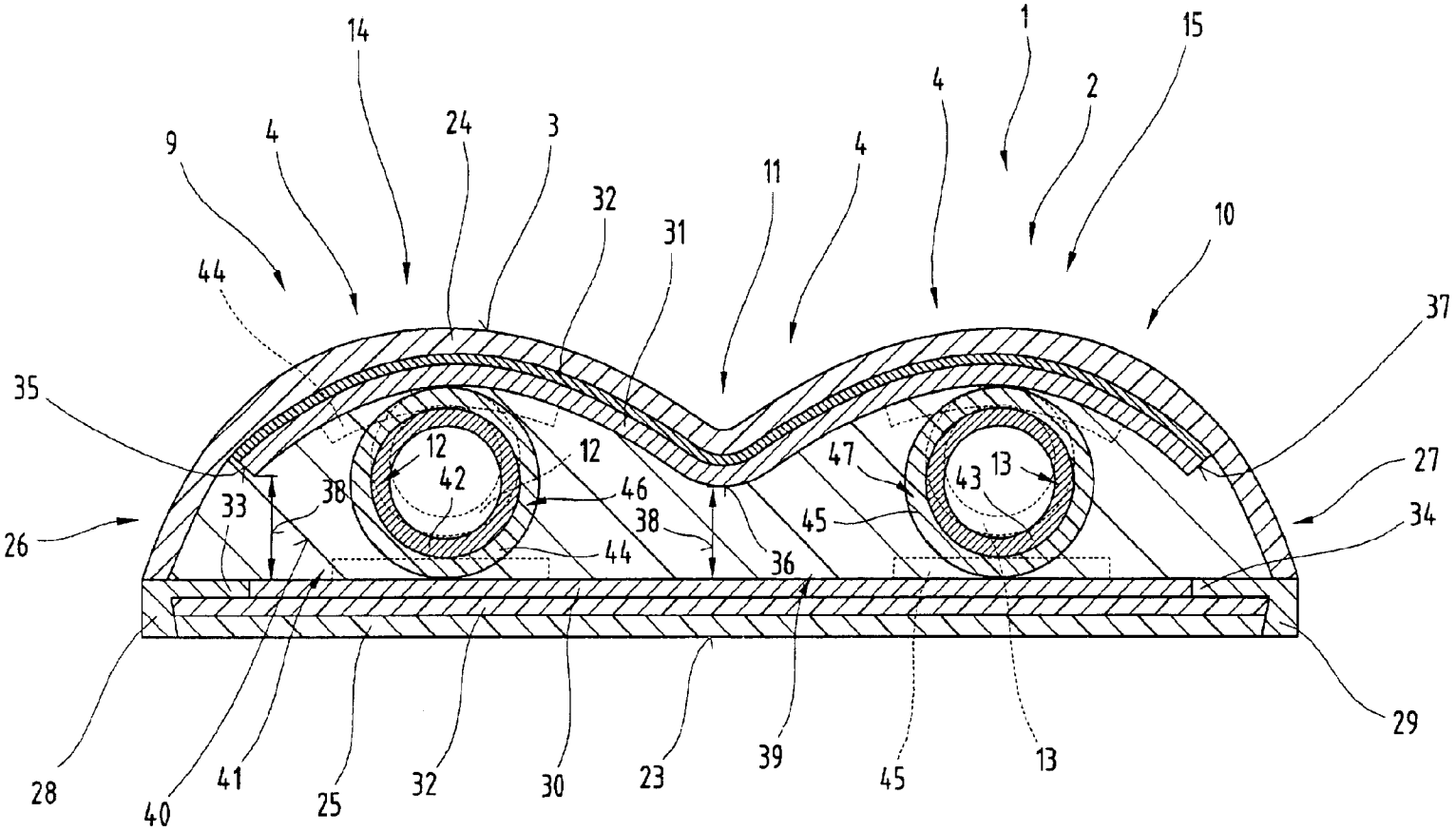
FIG. 2 is a cross section of the runner device illustrated in FIG. 1, viewed along the lines II—II of FIG. 1.

FIG. 2 depicts one possible structure of the runner device 1 proposed by the invention. This diagram, viewed in cross section, is specifically intended to illustrate the layered structure and cross-sectional shape of the individual components and elements of the runner device 1.

The outer peripheral zones of the runner device 1 consist, in a known manner, of a top layer 24 forming the top face 3 and a running surface lining 25 forming the running surface 23. The top layer 24 forms the top face 3 and optionally also longitudinal side walls 26, 27 of the runner device 1. Steel edges 28, 29 form a lateral boundary of the running surface 23. Instead of using a top layer 24 in the form of a shell component in a single piece forming the surface and lateral edges of the runner device 1 in a single-shell arrangement, it would naturally also be possible to provide separate elements for the side edges of the runner device 1.

The profiled top layer 24 is preferably supported at its two longitudinal edges on a steel edge 28; 29 or on a layer of high-tensile material lying in between.

Several layers are arranged between the top layer 24 and the running surface lining 25, in particular at least one bottom belt 30 lying immediately adjacent to the running surface lining 25 and/or at least one top belt 31 immediately adjacent to the top layer 24. The bottom belt 30 and/or the top belt 31 are made from a high-tensile material and are positioned close to the peripheral zones of the runner device 1 as viewed through the cross section of the runner device 1. The bottom belt 30 and/or the top belt 31 has a significant influence on the rigidity or flexibility of the runner device 1, amongst other things due to its spatial position within the runner device 1.

The top belt 31 is adhesively joined to the top layer 24 by means of a filler or adhesive layer 32. Similarly, the flat faces of the bottom belt 30 and the running surface lining 25 directed towards one another are adhesively joined to one another by means of a filler or adhesive layer 32. This being the case, the bottom belt 30 may extend between anchoring projections 33, 34 provided in the runner device 1 for the steel edges 28, 29, as schematically illustrated. Alternatively, the bottom belt 30, provided in the form of a substantially flat strip-like component, may extend beyond the anchoring projections 33, 34, terminating flush with the longitudinal side walls 26, 27 of the runner device 1.

By contrast with the largely flat bottom belt 30, the top belt 31 is preferably profiled. By preference, the top belt 31 is moulded so as to have at least one, preferably two raised areas 14, 15 running in its longitudinal direction with a recess 11 lying in between. Viewed in cross section, therefore, the top belt 31 duly formed from a flat workpiece is of a corrugated design. This cross-sectional corrugated design with preferably two raised areas 14, 15 with the recess 11 in between is dimensioned so that bottom longitudinal edges 35 to 37 of the shaped top belt 31 can be arranged at a distance 38 apart from the steel edges 28, 29 and the bottom belt 30. This distance 38 is maintained in order to prevent the profiled top belt 31 from coming into contact with the steel edges 28, 29 or the bottom belt 30.

This distance 38 is primarily determined by a core component 39 of the runner device 1, of which at least one is provided. This distance 38 is also kept largely constant when forces are acting on the top face 3 and/or the running surface 23, with the exception of relatively short permitted compression paths of the runner device 1. The core component 39 is disposed between the bearing belts, in particular between the bottom belt 30 and the top belt 31. Accordingly, the core component 39 keeps the bottom belt 30 spaced apart from the top belt 31 and, in conjunction with the other layers of the overall runner device 1, form an integral multi-layered or sandwich element as a result of filler or adhesive layers disposed in between.

The profiled section 12, 13 co-operates with the core component 39 and the profiled sections 12, 13 form a part of the core component 39 of the runner device 1. The space between top and bottom belt 30, 31 which remains free around the profiled sections 12, 13 is filled with a filler 40, preferably a synthetic material with a pore structure. The filler 40 preferably also has an adhesive effect so that it remains adhered to the adjoining components, thereby ensuring that the integral structure of the multi-part runner device 1 remains intact.

The filler 40 may also form an expanded foam core 41 for the runner device 1. The profiled sections 12, 13 and the filler 40 or expanded foam core 41 form the core component 39. The profiled sections 12, 13 may be embedded in the filler 40 or expanded foam core 41. The elasticity or flexibility of the filler 40 or expanded foam core 41 is selected so that the latter will not break and will not be susceptible to tearing when the runner device 1 is deformed to its maximum. The profiled sections 12, 13, which are highly tensile compared with the expanded foam core 41, are therefore mounted in the expanded foam core 41 in an almost elastically resilient arrangement.

The profiled sections 12, 13 are preferably provided in the form of hollow sections 42, 43 so that they have as low an inherent weight as possible but are still capable of relatively high values in terms of stability and strength. In the embodiment illustrated as an example here, the hollow sections 42, 43 are tubular. By reference to the longitudinal extension of the profiled sections 12, 13, the latter may have a tubular cross section with a circular contour, especially in the mid-region. By reference to individual cross-sectional planes in the longitudinal direction of the runner device 1, therefore, the respective cross-sectional shapes and/or the cross-sectional dimensions of the integrated profiled sections 12, 13 are at least more or less adapted to the respective cross-sectional shapes and contouring 4 of the top face 3 of the individual longitudinal portions of the runner device 1. In other words, the cross-sectional shapes and/or cross-sectional dimensions of the profiled sections 12, 13 at least partially conform to the contouring 4 of the top face 3 along their longitudinal extension. The profiled sections 12, 13 are therefore decisive contributory factor as far as the surface contour of the runner device 1 is concerned. The cross-sectional shapes and/or cross-sectional dimensions of the profiled sections 12, 13 transversely to the longitudinal extension of the runner device 1 are constant, being selected so that the profiled sections 12, 13 run quite close to the top belt 31 and/or the bottom belt 32. Optionally, at least one profiled section 12, 13 may immediately adjoin the bottom face of the top belt 31 and/or the top face of the bottom belt 30, as indicated by the profiled section 12, 13 shown in broken lines.

The top and/or bottom part-region of the outer shell of the profiled sections 12, 13 preferably runs close to the facing planar faces of the top belt 31 and/or the bottom belt 30 so that another specific thickness of the filler 40 of the expanded foam core 41 can be provided to form an elastic layer 44, 45 between the profiled sections 12, 13 and the bottom and/or top belt 30; 31, all of which are highly tensile compared with the expanded foam core 41.

Alternatively, an elastic layer 44, 45 provided as a separate layer may be arranged between the external shell of the profiled section 12,13 and the bottom belt 30 and/or top belt 31, as illustrated by broken lines. This elastic layer 44, 45 is preferably made from an elastomeric material, for example silicone rubber and/or rubber materials.

Instead of a flat, elastomeric intermediate layer, the elastic layer 44, 45 may also be provided in the form of a sheath 46, 47 of elastomeric material, at least partially covering or enclosing the profiled section 12, 13. This elastomeric sheath 46, 47 therefore directly adjoins the bottom face of the top belt 31 and/or the top face of the bottom belt 30. This elastically flexible sheath 46, 47 may also provide compensation between the cross-sectional dimensions of the profiled section 12, 13 and the profiling of the top belt 31, enabling smaller dimensional tolerances to be compensated by the flexible sheath 46, 47 during manufacture, i.e. when assembling and pressing the ski components under the effect of pressure and temperature in a press. The elastically flexible sheath 46, 47 and the elastic layers 44, 45 or intermediate layers also ensure that two profiled sections 12, 13 are accurately and always uniformly aligned in the mid-region between the top and bottom belt 30, 31. This imparts a high reproducibility to the runner device 1, ensuring that a plurality of runner devices 1 will always have uniform and largely constant properties.

In addition, the elastic layer 44, 45 and the elastic sheath 46, 47 enable the profiled sections 12, 13 to be exactly positioned during manufacture of the runner device 1. Prefixed and retained in an appropriate press between bottom and top belt 30, 31 by the elastic layer 44, 45 and the sheath 46, 47 during manufacture of the runner device 1, the profiled section 12, 13 can no longer shift or slide once the expandable filler 40 is introduced. As a result, the profiled sections 12, 13 remain in the specified position during the manufacturing process, ensuring that the specified physical properties will be imparted to the runner device 1. Moreover, there is absolutely no need for any other measures to fix the profiled sections 12, 13 in the intended position when injecting in the filler 40 because elastically clamping the profiled sections 12, 13 between the surrounding components of the runner device 1 in an appropriate pressing mould will be sufficient to ensure that the profiled sections 12, 13 sit in the intended position. This being the case, the elastic layer 44, 45 and the elastic sheath 46, 47 are at least slightly compressed or pushed in at the contact points with the surrounding components, in particular the contact points with the top belt 31 and/or the bottom belt 31. Provided the elastic layer 44, 45 is designed and dimensioned correctly, the elastically resilient mounting of the profiled section 12, 13 in the runner device 1 will be maintained whatever the circumstances.

Embedding the profiled sections 12, 13 in the core component 39 in an almost elastic arrangement is of advantage because it is conducive to the running properties of the runner device 1, but especially its agility or dynamics. Particularly in the initial phase of a deformation of the runner device 1, the deformation of the elastic layer 44, 45 and the sheath 46, 47 can be compensated by the mounting of the profiled sections 12, 13 in the core component 39, which is of limited flexibility, and the profiled section 12, 13 will remain undeformed.

The profiled section 12, 13 will not be deformed or flexed until the deforming motion starts to become more pronounced. A body is thus formed which bends in two stages but which is nevertheless capable of a harmonious bending curve. The profiled sections 12, 13 with the elastic sheath 46, 47 or the adjoining elastic layer 44, 45 are the elements which essentially serve to maintain the distance 38 between the top belt 31 and the bottom belt 30. The top layer 24 is preferably provided as a transparent synthetic material, which provides a design feature for the runner device 1 on the bottom face directed towards the profiled sections 12, 13. The top layer 24 has relatively little influence on the rigidity or stiffness of the runner device 1.

Because the top belt 31 is flexibly spaced at a distance apart from the bottom belt 30, the arrangement could be described as an uncoupling of the top belt 31 from the bottom belt 30. Accordingly, the top belt 31 is mounted so that it fulfils a damping action relative to the bottom belt 30 and is mounted so as to flex and rebound in the direction perpendicular to the runner device 1. Consequently, any impact or vibrations acting on the running surface 23 can be kept remote from the top face 3 of the runner device 1 to a certain degree, resulting in a low-vibration or smoother running behaviour of the runner device 1 on ridged ground.

The top layer 24, which may also be described as a design layer, is therefore able to compensate for and absorb the relatively short displacement travel in the vertical direction without problem. Shearing forces between the lower layers of the runner device 1, in particular between the bottom belt 30 and the upper layers of the runner device 1, in particular the top belt 30, are absorbed on the one hand by the filler 40 and on the other by the expanded foam core 41. In addition, the stability of the runner device 1 when subjected to shearing forces is increased by the fact that the shape of the top belt 31 conforms to the profiled sections 12, 13.

Figure 3:
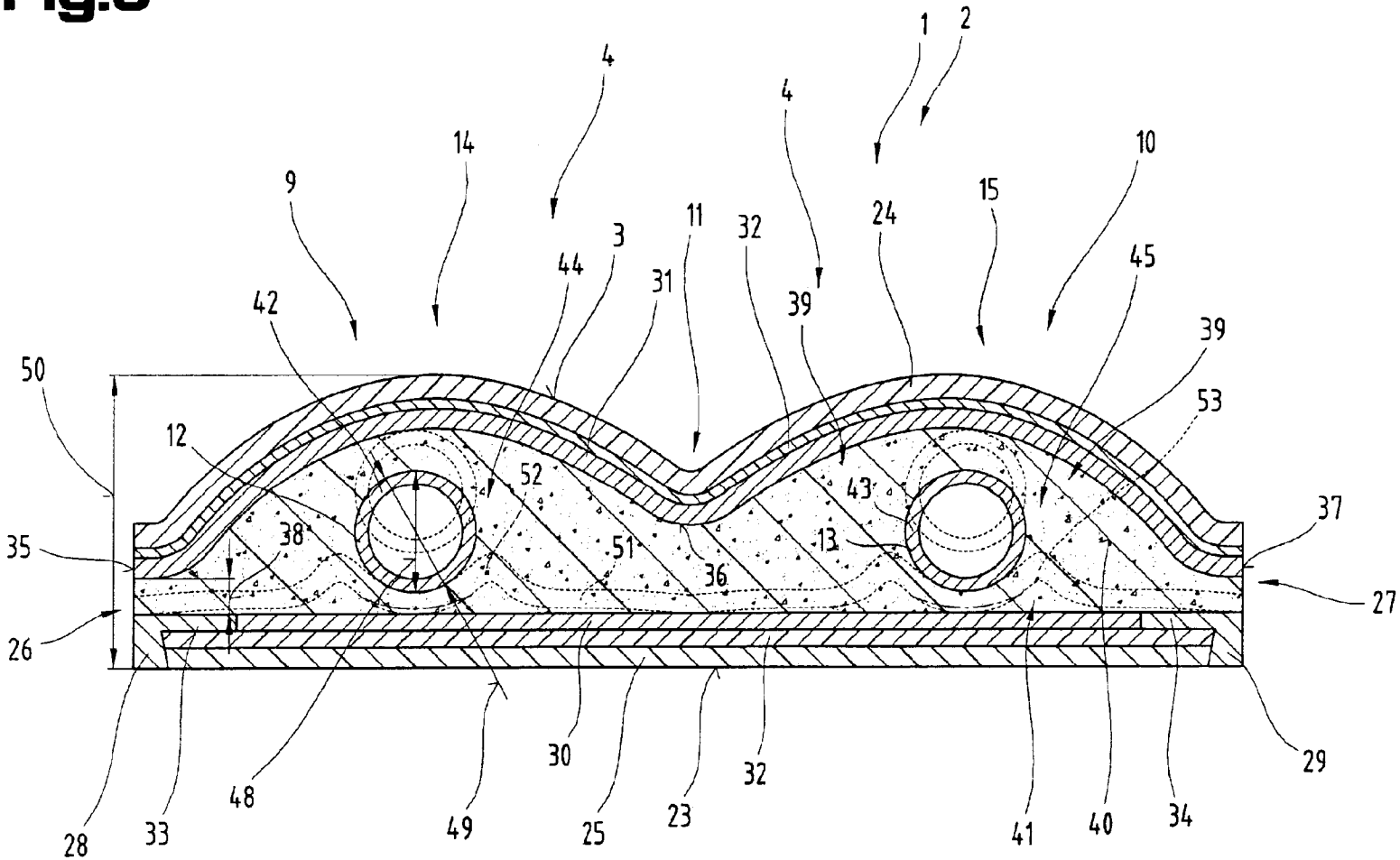
FIG. 3 is a simplified diagram in cross section, not shown to scale, of another embodiment of the runner device illustrated in FIG. 1.

FIG. 3 illustrates an alternative embodiment of the structure of a runner device 1 as proposed by the invention and illustrated in FIG. 1. The reference numbers used to denote the parts already described above and the relevant explanations may be transposed to the same parts with same reference numbers.

By contrast with the embodiment described above, the upper components of the runner device 1 in this case do not extend across the core component 39 in a shell-type arrangement and instead a relatively narrow part-region of the filler 40 or expanded foam core 41 may be seen along the longitudinal side walls 26, 27 of the runner device 1. In particular, the upper components of the runner device 1 are angled in a flange-like design at their longitudinal edges directed towards the steel edges 28, 29 so that the narrow ends of these components form a part-region of the side walls 26, 27.

This being the case, the filler 40 or expanded foam core 41 are made from a particularly elastic, expanded synthetic material, which, apart from its elastic properties, also serves as an adhesive. The profiled sections 12, 13 are preferably embedded in a filler 40 or expanded foam core 41 with a density of between approximately 200 kg/m$^3$ and 400 kg/m$^3$, preferably approximately 300 kg/m$^3$. This expanded material therefore has relatively elastic properties. An expanded foam core 41 of this type is much lighter than a wooden core and is also elastically flexible. The filler 40 or expanded foam core 41 used for the runner device 1 proposed by the invention is also not susceptible to breakage, nor is it porous, but has a relatively high coefficient of elasticity.

As illustrated by the numerous dots or spots, the filler 40 may also be provided as an integral foam, the peripheral zones of which are more dense and harder than the inner section. An integral foam of this type also has an outer skin, which is of a significantly higher density than the core zone. Because the expanded synthetic material of the expanded foam core 41 is less dense in the middle, the core region has a considerably higher elasticity and a higher elastic flexibility than the peripheral zones. At least one profiled section 12, 13 is therefore elastically inlaid in this relatively soft core region of the expanded foam core 41. The relatively rigid, homogeneous outer skin of the expanded foam core 41 helps to maintain its dimensional stability and compression strength and therefore constitutes an advantageous core component 39 for the runner device 1. The outer skin and peripheral zone has a bulk density of around 1200 kg/m$^3$ and the density at the centre of the expanded foam core 41 is between approximately 200 kg/m$^3$ and approximately 400 kg/m$^3$. The hard peripheral zones may be approximately 2 mm to 5 mm in thickness.

The cross-sectional dimensions, in particular a height 48 or a diameter 49 of the profiled sections 12, 13 is at least one third (33%) up to a maximum of two thirds (66%), preferably approximately half (50%) of a largest structural height 50 of the runner device 1 in the same cross-sectional plane. The external contour and cross-sectional dimension, in particular the height 48 of the profiled sections 12, 13, therefore has a significant effect on the contouring 4 or external contour of the runner device 1. Since the contouring 4 of the top face of the runner device is designed in the form of bead-type raised areas 14, 15, the height 48 of the profiled sections 12, 13 may be larger than is the case with a runner device 1 with a conventional rectangular or trapezoidal cross section. An increase in the weight or volume of the runner device 1 due to the bead-type raised areas 14, 15 is avoided due to the recess 11 between the two raised areas 14, 115 and it is even possible to produce a lighter-weight runner device 1 for the same static values. In spite of the fact that the maximum structural height 50 is larger than is the case in conventional runner devices 1, the volume or weight is not necessarily increased because the recess 11 is provided. In effect, better static values, in particular higher torsional strengths, can be achieved since the contouring 4 of the top face 3 of the runner device 1 and the fact that the profiled sections 12, 13 are integrated allows weaker, i.e. thinner, structural elements, to be used.

To render the sandwich or multi-layered element capable of withstanding the high shearing forces to which it will be exposed transversely to the longitudinal direction of the runner device 1, the lower layers of the runner device 1 mesh with the upper layers by means of the profiled sections 12, 13. Accordingly, the lower layers, in particular the bottom belt 30, and the upper layers, in particular the top belt 31, are joined in a reciprocal positive coupling, incorporating the profiled sections 12, 13. The positive coupling between the top belt 31 and the bottom belt 30 using the profiled sections 12, 13 ensures that shearing forces acting between the bottom belt 30 and the top belt 31 transversely to the longitudinal direction of the runner device 1 are effectively absorbed without allowing any significant shifting between the top belt 31 and the bottom belt 30.

To this end, the profiled sections 12, 13 may be retained on their own separate fixing mount 51 lying immediately adjacent to the lower peripheral zone of the runner device 1 or in an appropriately shaped region of the bottom belt 30. The fixing mount 51 or the appropriately shaped bottom belt 30 provides mounts 52, 53 specifically adapted to the external contour of the profiled sections 12, 13 which receive the profiled sections 12, 13. If the profiled sections 12, 13 are tubular, the mounts 52, 53 of the fixing mount 51 or the bottom belt 30 are well or dish-shaped and may receive at least the lower part-region of the profiled sections 12, 13. As a result of the bead-type raised areas 14, 15 and hence the more or less matching contouring 4, the top belt 31 also matches the corresponding upper part-region of tubular profiled sections 12, 13. The profiled sections 12, 13 are therefore also used and provided as a means of transmitting shearing forces between the bottom belt 30 and the top belt 31, making it perfectly feasible to use a very elastic filler 40 or expanded foam core 41.

In conjunction with the virtually matching top belt 31 and the virtually matching bottom belt 30, the profiled sections 12, 13 in effect constitute a sort of vertical guide between top belt 31 and bottom belt 30.

Optionally, the underside of the dish-shaped mounts 52, 53 may also be spaced at a distance apart from the bottom belt 31 and from the layers of the runner device 1 constituting the bottom belt 31, as illustrated by broken lines. Accordingly, the fixing mount 51 also acts as a springing point for the profiled section 12, 13 in the direction running perpendicular to the running surface 23 of the runner device 1. The fixing mount 51 may therefore be made of spring steel or any other suitable material with elastically resilient properties.

Instead of providing a fixing mount 51 extending across the entire length of the runner device 1 or instead of using a correspondingly extensive spring element, springing elements of this type may be provided which co-operate with individual points of the lower external surface region of the profiled sections 12, 13 only, in which case elastically resilient supports which act on certain points may be provided in the multi-layered element for the profiled sections 12, 13.

Figure 4:
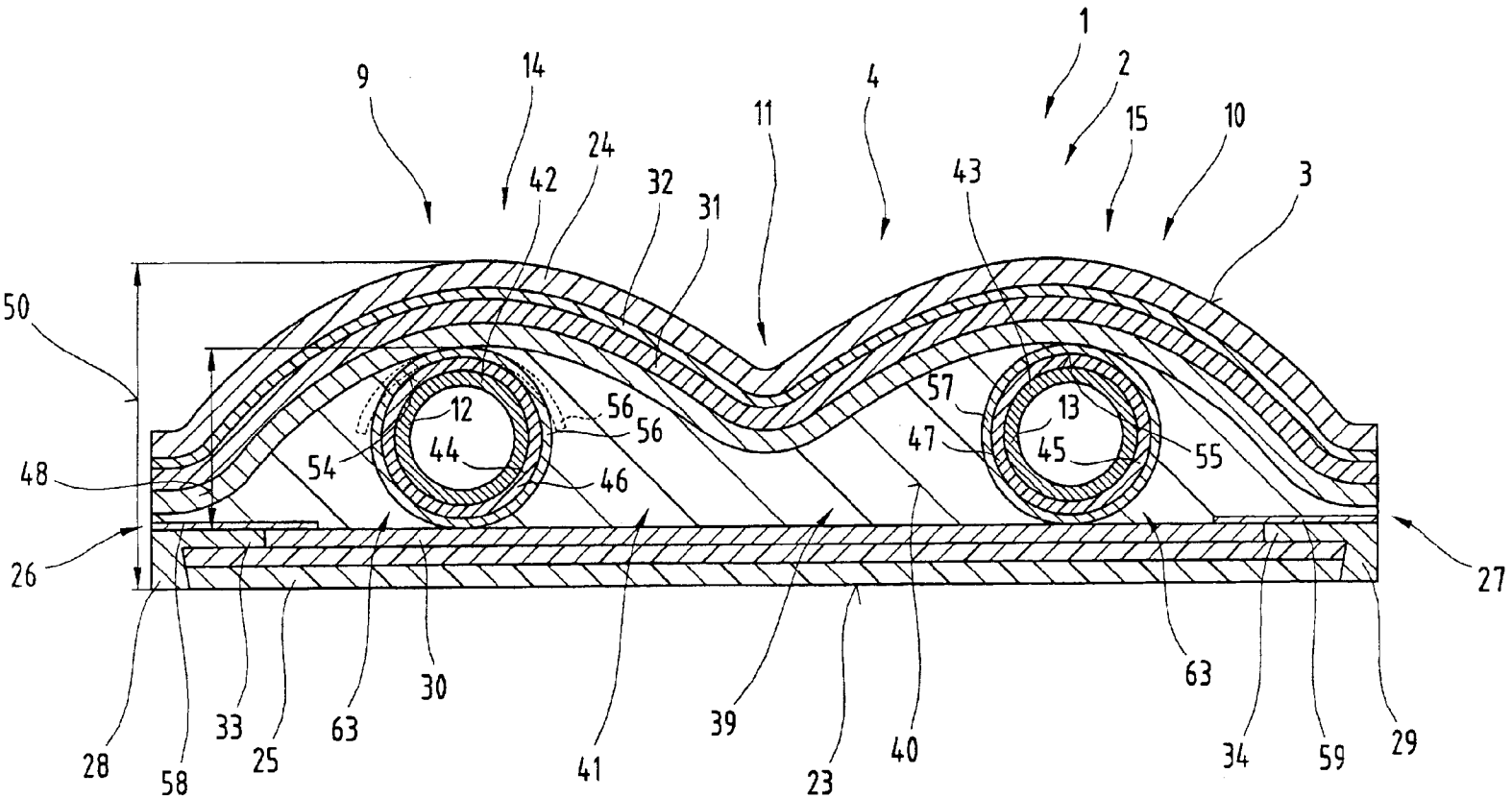
FIG. 4 is a simplified diagram in cross section, not shown to scale, of another embodiment of the runner device illustrated in FIG. 1, with at least one integrated double section.

FIG. 4 illustrates another embodiment of the structure of a runner device 1 as proposed by the invention, the same reference numbers being used to denote the same parts described above. The explanations given above may be transposed in terms of meaning to these parts.

In this instance, at least a part-region of the outer shell of the at least one profiled section 12; 13 with the elastic layer 44, 45 provided in between lies against an internal surface 54; 55 of another profiled section 56; 57 which at least partially encloses the profiled section 12; 13. The outer profiled section 56; 57 at least partially enclosing the first or inner profiled section 12; 13 may be semi-circular or alternatively triangular in cross section—as illustrated by the broken lines—its internal surface 54; 55 preferably co-operating with the upper external surface region of the first profiled section 12, 13. This being the case, the outer or second profiled section 56, 57 covers the first profiled section 12, 13 lying underneath and an elastic layer 44; 45 is disposed in between them.

Figure 13:
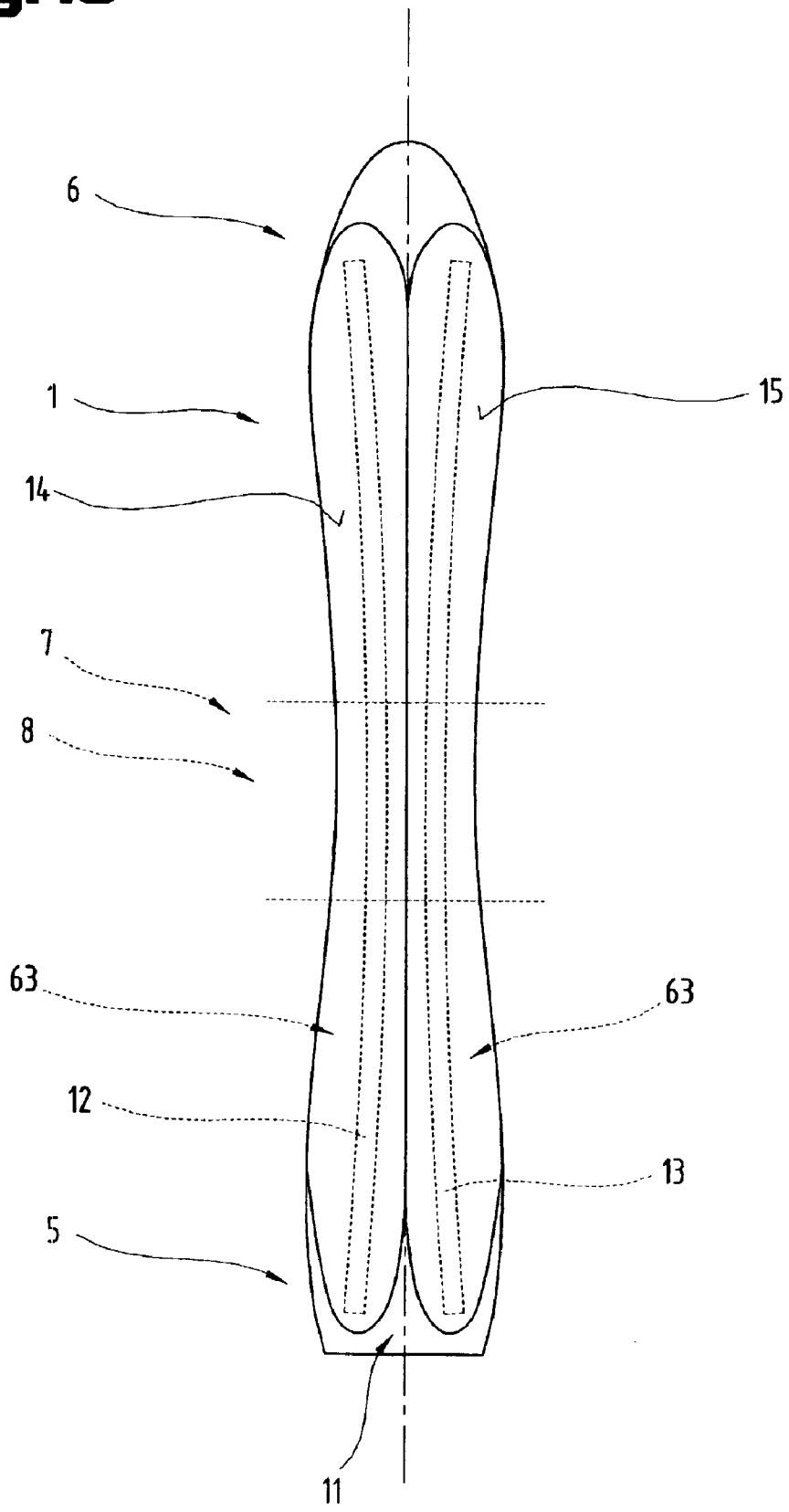
FIG. 13 is a plan view of a runner device with two integrated moulded or double sections, which are of an arcuately curved shape and extend in a diverging arrangement, starting from the mid-region.

Instead of using a well-shaped or channel-shaped profiled section 56, 57, it would also be possible to use a profiled section 56, 57 with a closed shell—as specifically illustrated in FIG. 4 13 for example a tubular profiled section 56, 57. This being the case, the first profiled section 12, 13 is placed or inserted inside this profiled section 56, 57 with its closed casing and the elastic layer 44, 45 if placed in between. This "section in section" arrangement with the elastic layer 44, 45 disposed between the rigid section walls provides a multi-layered flexural or core element capable of withstanding high shearing forces. A double-walled element of this type comprising the profiled sections 12, 56 and 13, 57 has good damping and strength properties. The system of tubular profiled sections 12, 56 and 13, 57 can be described as a double-walled tubular element with an intermediate elastic layer.

With a double-walled structure of the profiled elements 12, 56 and 13, 57 of this type, the outer profiled section 56, 57 may be deformed within certain limits without the profiled section 12, 13 lying inside being subjected to any deformation. The profiled section 12, 13 lying inside is not deformed until a stage of more pronounced deformation and the deformation resistance increases as the curvature increases.

Amongst other things, the longitudinal side walls 26, 27 may be provided in the form of lateral web elements 58, 59 varying in height in their longitudinal direction, the different cross-sectional heights of the runner device 1 being taken into account in the individual cross-sectional regions. These lateral web elements 58, 59 are supported on the top face of the steel edges 28, 29 in a known manner.

Figure 5:
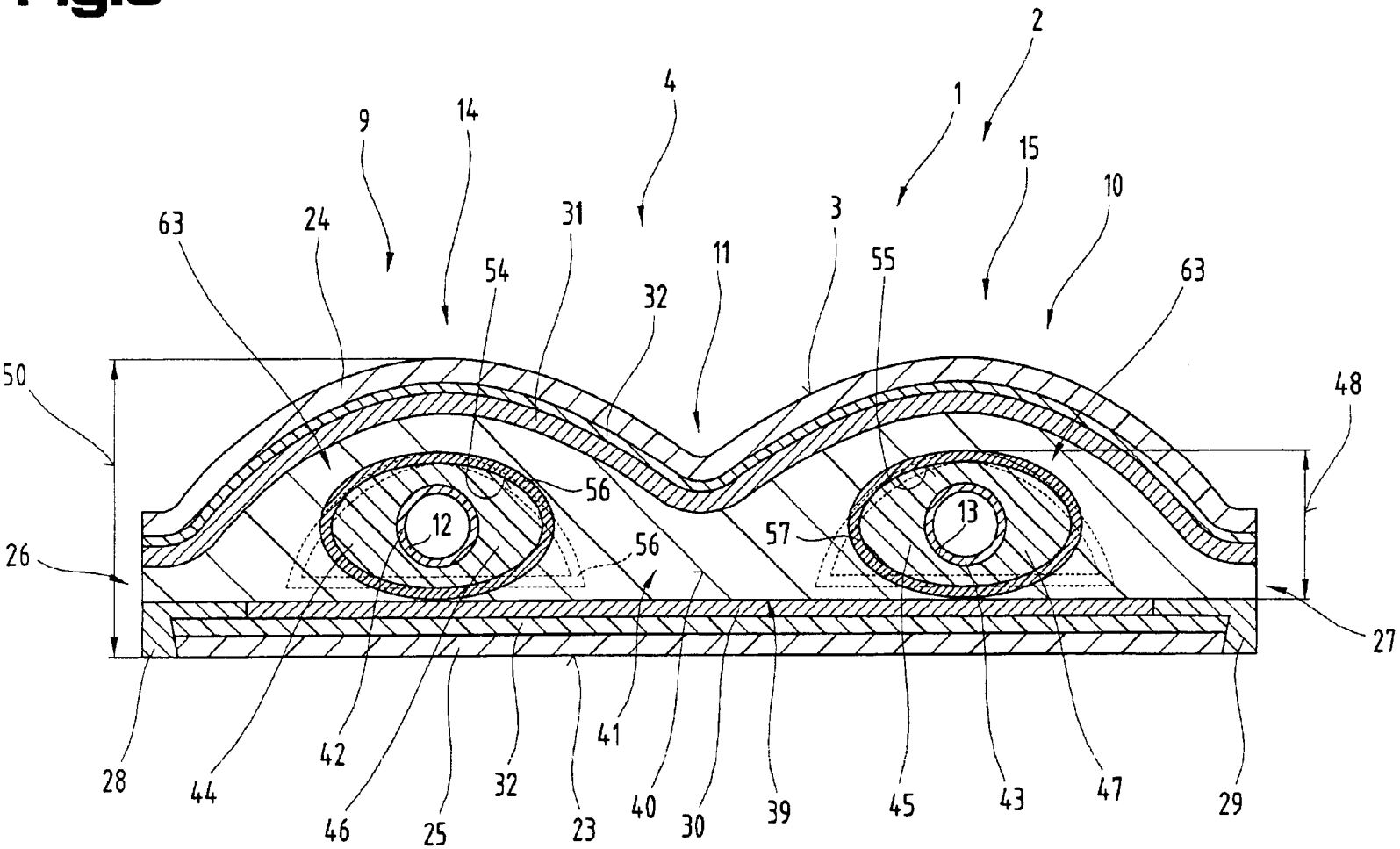
FIG. 5 is a simplified diagram in cross section, not shown to scale, of another embodiment of a runner device.

FIG. 5 illustrates an alternative embodiment to that illustrated in FIG. 4. In this case, the outer profiled sections 56, 57 are oval or elliptical in cross section. These profiled sections 56, 57 with an elliptical cross section are integrated in the runner device 1 laid flat. In particular, by reference to the oval or elliptical cross section of the outer profiled section 56, 57, a straight line joining its tips is aligned substantially parallel with the running surface 23 of the runner device 1. The cross-sectional dimensions of the respective inner profiled section 12, 13 are significantly smaller than the cross-sectional dimensions of the profiled section 56, 57, so that the inner profiled section 12, 13 is fully accommodated and the outer profiled section 56, 57 and can be completely embedded in the elastic layer 44, 45.

Instead of the elliptical cross section, the outer profiled section 56 may also have a semi-circular or bridge-shaped cross section—as indicated by broken lines—in which case the curved part-region will be directed towards the almost congruently shaped top belt 31 and the substantially flat base part will be directed towards the substantially flat bottom belt 32. The advantage of providing the profiled sections 56, 57 with an elliptical or semi-circular cross section with correspondingly shaped profiled sections 12, 13 lying inside is that they can be adapted to the corrugated contour of the top belt 31 or top face 3 of the runner device 1 over a larger peripheral surface area. A more extensive positive connection is thus obtained between the top belt 31 and the profiled sections 56, 57 or alternatively profiled sections 12,13, and the runner structure is therefore capable of withstanding higher shearing forces. The top or bottom vertex of the profiled section 56, 57 may abut directly with the top belt 31 or the bottom belt 30. In the rest of the vertex region, the elastically flexible filler 40 of the expanded foam core 41 is disposed between the profiled section 56, 57 and the top belt 31 and bottom belt 30.

The compression strength or inherent stability of the profiled sections 12, 13, 56, 57 is thus significantly greater than the compression strength of the elastic layer 44, 45. When subjected to the action of force, the elastic layer 44, 45 deforms or gives at a much earlier point than the profiled sections 12, 13, 56, 57.

Figure 6:
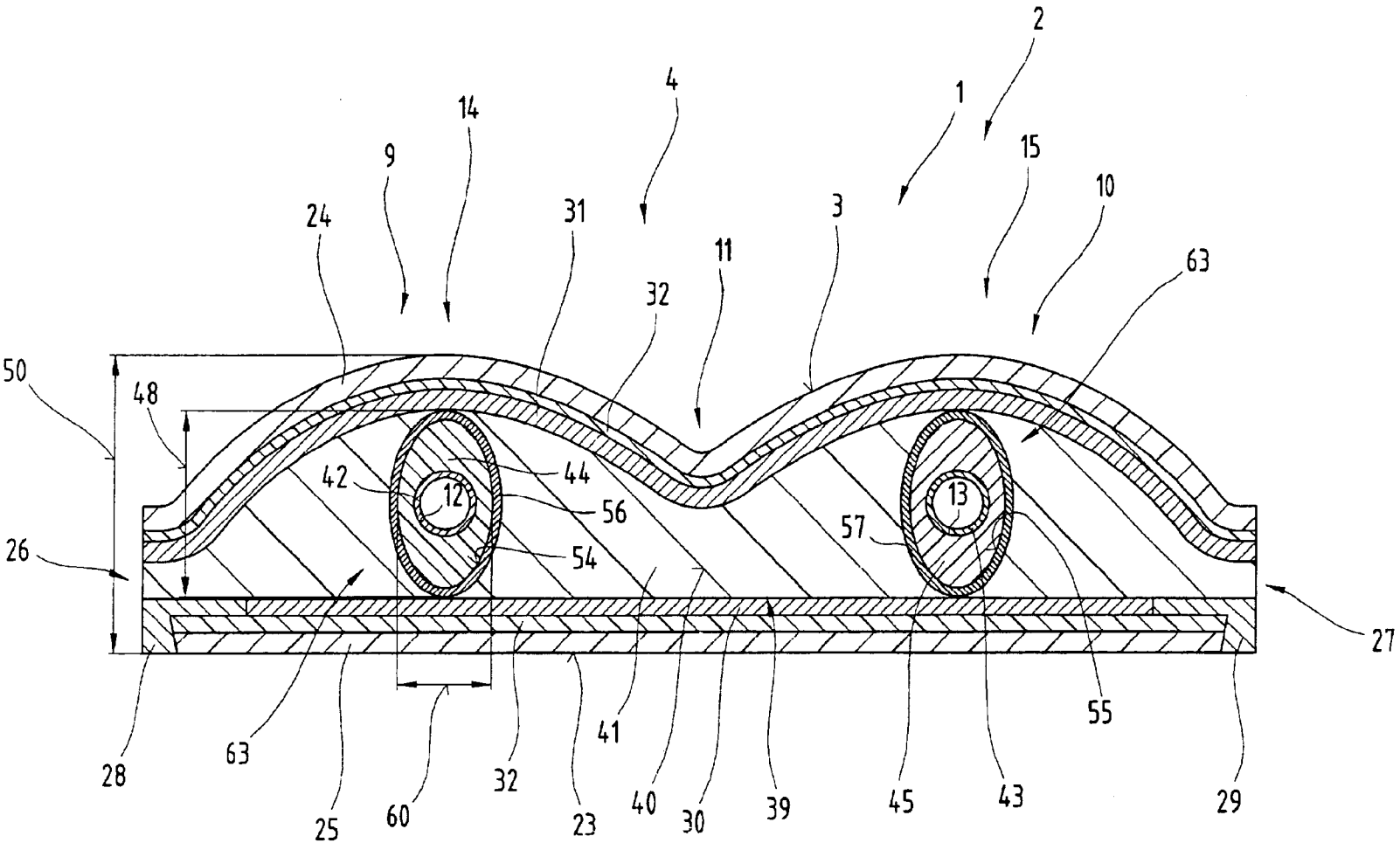
FIG. 6 is a simplified diagram in cross section, not shown to scale, of another embodiment of a runner device.

FIG. 6 illustrates an alternative embodiment to the embodiment illustrated in FIG. 5.

In this case, the profiled sections 56, 57 also have an elliptical or oval cross section but the profiled sections 56, 57 are integrated in the multi-layered body of the runner device 1 with the cross section upstanding. In particular, a straight line linking the tip regions of the oval profiled section 56, 57 runs substantially perpendicular to the running surface 23 of the runner device 1. The cross-sectional height, in particular a height 48, of the profiled sections 56, 57 is selected so that the top belt 31 and the bottom belt 30 abuts with or against the tip regions of the profiled section 56, 57. The profiled section 56, 57 therefore acts as a spacing element between the top belt 31 and the bottom belt 30. An inside width 60 of the hollow profiled section 56, 57 is selected so that the inner profiled section 12, 13 does not sit in contact with the internal faces of the outer profiled section 56, 57. The inner profiled section 12, 13 is therefore able to move to a limited degree relative to the outer profiled section 56, 57 in the direction perpendicular to the running surface 23 of the runner device 1, once it has been placed inside the elastic layer 44, 45 in the interior of the profiled section 56, 57. The inner profiled section 12, 13 is therefore embedded in the outer profiled section 56, 57 in an almost floating arrangement. Consequently, counter-vibrations can be generated in response to the natural vibrations of the runner device 1, thereby enabling its natural vibrations to be damped.

Figure 7:
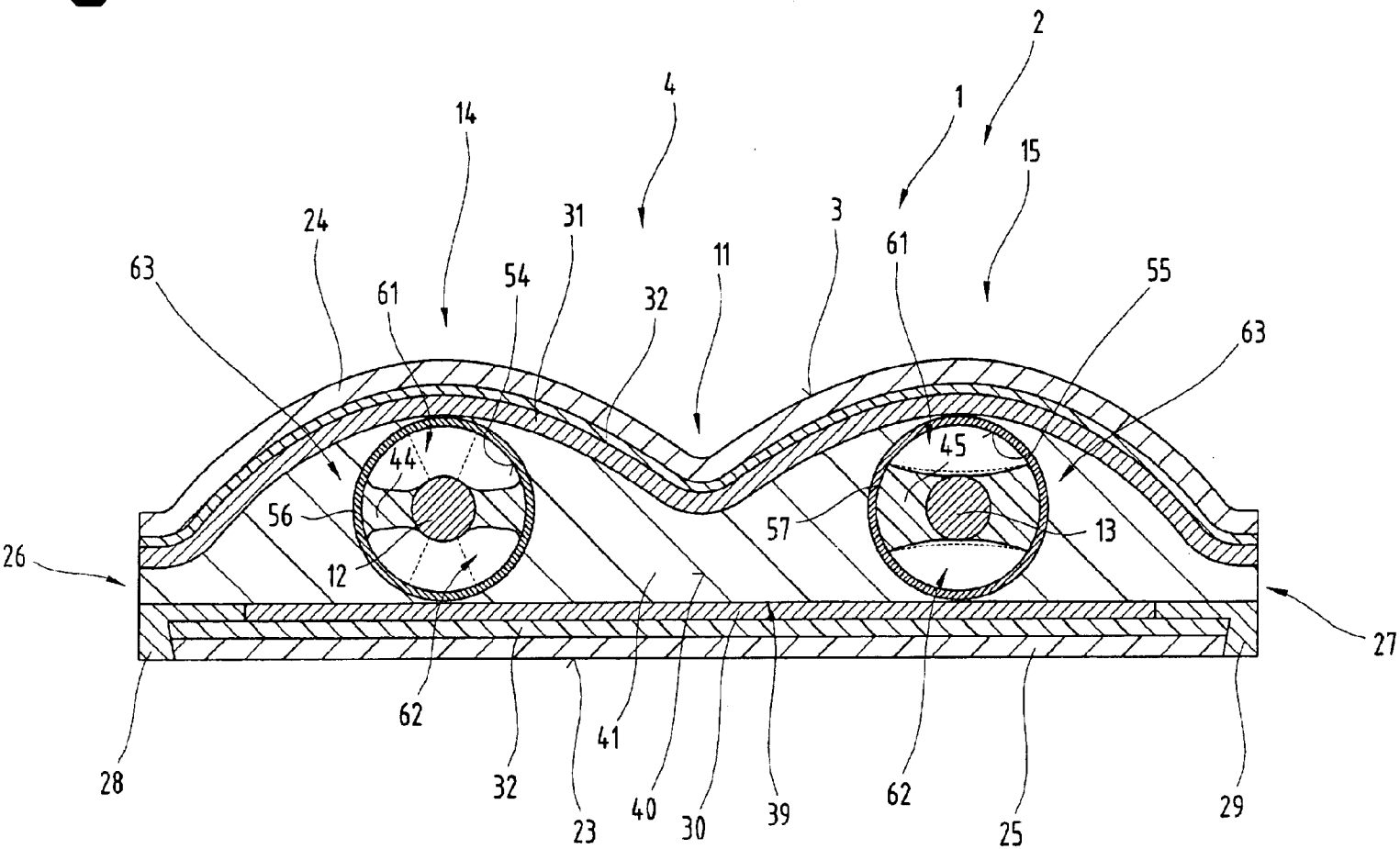
FIG. 7 is a simplified diagram in cross section, not shown to scale, of an alternative embodiment of the runner device.

FIG. 7 shows a cross section through another embodiment of the runner device 1 proposed by the invention.

A core component 39 is provided, again consisting of several elements. In particular, at least one multi-part profiled section 12, 56 and 13, 57 is used. The inner profiled section 12, 13 is retained and positioned in the interior of the outer profiled section 56; 57 by means of the elastic layer 44; 45. The inner profiled section 12; 13 is substantially concentric with the outer profiled section 56; 57 and the longitudinal axes of the profiled sections 12, 56 and 13, 57 inserted one inside the other are largely congruent. By preference, the longitudinal mid-axes of the profiled sections 12, 56 and 13, 57 are also disposed in a same alignment or orientation.

The elastic layer 44; 45 and the profiled section 12; 13 do not occupy the entire interior of the outer profiled section 56; 57. Instead, at least one cavity 61, 62 remains free between the outer shell of the inner profiled section 12; 13 and the internal surface 54; 55 of the outer profiled section 56; 57. Consequently, the elastic layer 44, 45 and the profiled section 12; 13 lying inside only partially fill the interior of the outer profiled section 56; 57.

As viewed through the cross section of the profiled sections 12, 56 and 13, 57, the elastic layer 44, 45 is provided in a web arrangement and retains the inner profiled section 12, 13 substantially centred relative to the outer profiled section 56; 57. The elastic layer 44, 45, of a web design in cross section, preferably runs in a plane parallel with the running surface 23 so that at least one cavity 61; 62 is left free above and/or below the profiled section 12; 13. The outer profiled section 56; 57 is therefore not completely filled with the elastic layer 44; 45.

Optionally, the retaining webs for the inner profiled sections 12; 13 formed by the damping layer 44; 45 may also extend between the inner profiled section 12; 13 and the outer profiled section 56; 57 in a radiating arrangement, thereby forming a plurality of cavities 61, 62.

The inner profiled sections 12; 13 may also be completely embedded in the elastic layer 44, 45 and the elastic retaining webs for the inner profiled section 12; 13 formed by it, preventing any direct contact between the high-tensile and relatively hard surfaces of the profiled sections 12, 56 and 13, 57 inserted one in the other.

The internally lying profiled section 12, 13 in particular may also be a solid body in order to produce high static bending characteristics in spite of the relatively small cross-sectional area.

The combined multi-layered component comprising the inner profiled section 12; 13, the outer profiled section 56; 57 and the elastic layer 44; 45 inlaid between, may be made by means of an extrusion process, for example. If using a so-called co-extrusion process, the entire combi-element used for the core component 39 can be produced in a single work process. This being the case, the profiled element 12, 56 or 13, 57 is made from an extrudable synthetic material and the elastic layer 44, 45 from an elastomeric material which has an adhesive action on cooling or curing so as to permanently join the profiled sections 12, 56 and 13, 57 inserted one inside the other.

If the profiled sections 12, 13, 56, 57 are made from metal, in particular aluminium, titanium or a suitable metal alloy, the elastic layer 44, 45 is preferably injected or introduced into the outer profiled section 56, 57 after inserting the inner profiled section 12; 13 and expanded.

An expanded synthetic material with appropriate elastic properties or alternatively a rubber or rubber-type material may therefore be used for the elastic layer 44, 45.

The ratio of flexural strength between the inner profiled section 12; 13 and the co-operating outer profiled section 56; 57 may be varied by modifying the cross-sectional surface areas, the cross-sectional dimensions, the wall thicknesses and the materials used. Similarly, the longitudinal dimensions of the profiled sections 12; 13, 56; 57 will determine which of the profiled sections 12; 13; 56; 57 is deformed first when the runner device 1 is subjected to bending stress and which of the profiled sections 12; 13; 56; 57 will counteract this deformation motion, at least during the initial phase of the displacement.

Above all, if using a double section 63 comprising an inner and an outer profiled section 12, 56 or 13, 57, a part-region of the outer surface of the outer profiled section 56, 57 may be joined to the layers of the bottom belt 30 and/or the layers of the top belt 31. Specifically for this purpose, at least part-regions of the contact points between the profiled section 56, 57 and the bottom or top belt 30; 31 are bonded.

Instead of using metal profiled sections 12, 13, 56, 57, it would naturally also be possible to integrate plastics sections or moulded elements made from fibre-reinforced plastics or any combination thereof in the runner device 1.

Figures 8, 9:
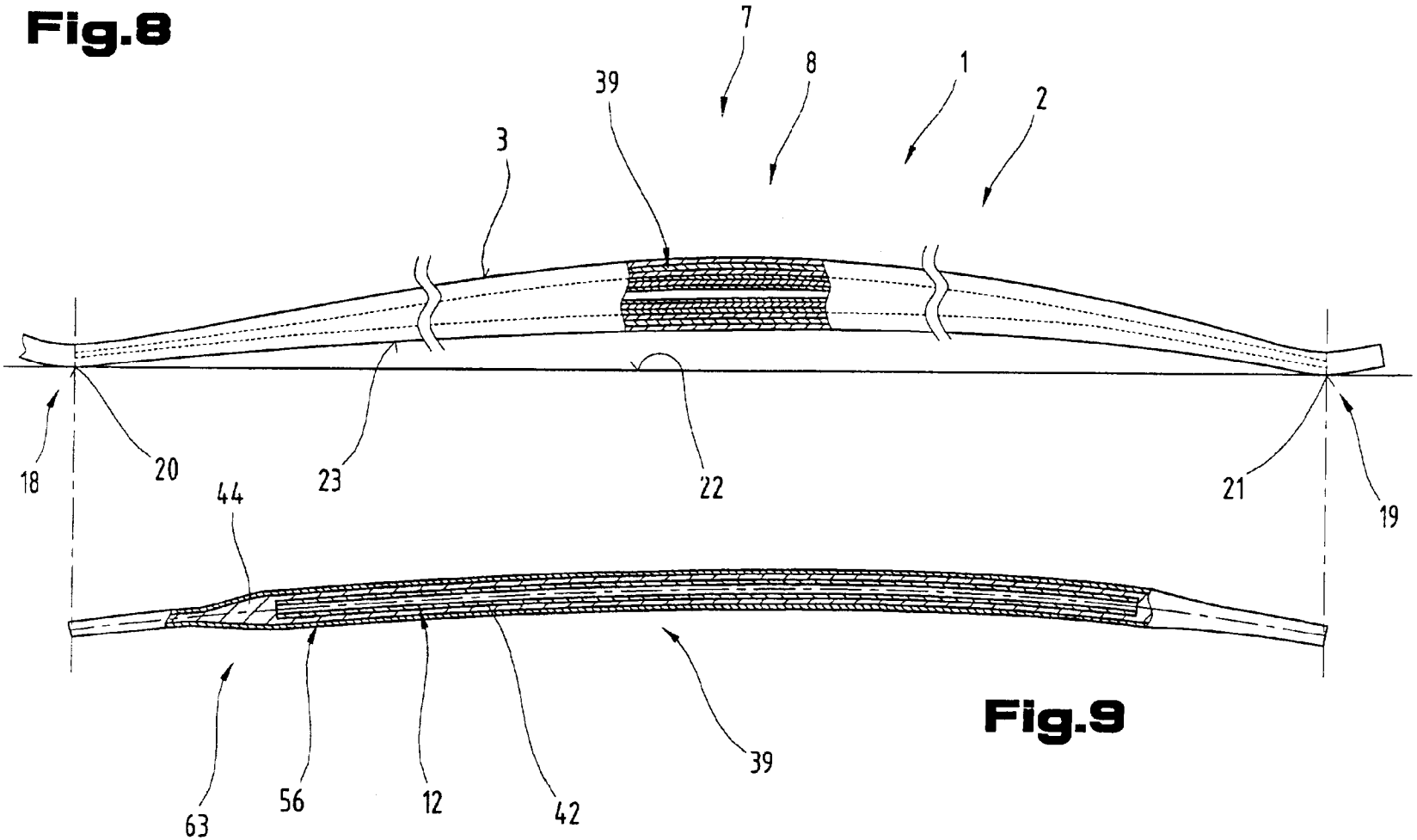
FIG. 8 is a very simplified schematic diagram of a part-region of a runner device as proposed by the invention, seen in partial section.
FIG. 9 is one possible embodiment of a double section, seen in partial longitudinal section, in the opposite position of the runner device illustrated in FIG. 8.

FIG. 8 provides a very simplified side view, not shown to scale, of a runner device 1 as proposed by the invention, showing the layout and arrangement of the profiled sections integrated in the runner device body. FIG. 9 illustrates the body of profiled sections illustrated in the runner device 1 of FIG. 8 but on a larger sale and out of proportion. Reference may be made to the explanations given above with regard to same parts denoted by the same reference numbers.

As may be seen, at least one profiled section 12; 13; 56; 57 extends as far as the contact zones 18, 19 of the runner device 1 with the flat underlying ground 22. In the no load-state, the contact zones 18, 19 and the respective strip-shaped or linear contact points 20, 21 of the running surface 23 of the runner device 1 are located in the end-face terminal regions of the runner device 1. Turning to the side view, the runner device 1 is arcuate or upwardly cambered with a specific pre-tensioning height between the contact zones 18, 19 and between the contact points 20, 21.

Starting from the mid-region 7 of the runner device 1, at least one profiled section 12; 13; 56; 57 extends to just short of the contact points 20 and/or 21 or at least slightly beyond the contact points 20 and/or 21 of the runner device 1.

A double section 63 of the type described above is also incorporated in this embodiment of the runner device 1. This double section 63, consisting of the first or inner profiled section 12; 13 and the second or outer profiled section 56; 57 enclosing it, more or less conforms to and is pre-shaped to the desired camber or longitudinal curvature of the runner device 1. In other words, the double section 63 already assumes a cambered or bridge-type shape, as viewed in cross section, before it is integrated in the runner device body. Since the double section 63 is already permanently pre-formed and already has a certain degree of pre-tensioning in the initial state, the springing properties and the dynamics of the runner device 1 can be varied by using the double section 63 or by using only one of the profiled sections 12; 13; 56; 57 pre-shaped accordingly.

The springing behaviour and elasticity of the runner device 1 are assisted amongst other things by the double section 63 or alternatively the individual profiled section 12; 13; 56; 57 provided in the form of a pre-tensioned arc extending continuously between the two contact zones 18, 19. These profiled sections 12; 13; 56; 57 are of crucial importance to the running or gliding behaviour of the runner device 1.

In the embodiment illustrated, the outer profiled section 56; 57 is longer than the inner profiled section 12; 13 embedded in the elastic layer 44; 45. The inner profiled section 12; 13 is positioned so that it is totally accommodated in the outer profiled section 56; 57. In other words, both terminal ends of the outer profiled section 56; 57 project beyond the two terminal ends of the inner profiled section 12; 13 and level out or flatten out to the thickness of the runner device 1. By preference, the end regions of the profiled section 56; 57 are flattened to the degree that the ends of the profiled sections 56, 57 are closed, forming a substantially flat end.

Optionally, the inner profiled section 12; 13 is arranged offset from the outer profiled section 56; 57 in the longitudinal direction so that at least an end region of the inner profiled section 12; 13 projects beyond one of the ends of the outer profiled section 56; 57.

The interior of the inner profiled section 12; 13 or hollow section 42; 43 may form a cavity as schematically indicated—in the double section 63. Alternatively, however, at the manufacturing stage, particularly during the injection or expansion process, the elastic layer 44; 45 may be allowed to penetrate the interior of the inner profiled section 12; 13.

As may be seen by comparing FIG. 8 and FIG. 9 in particular, the inner profiled section 12; 13 is completely enclosed by the elastic layer 44; 45, i.e. including at the terminal ends. Totally embedding the inner profiled section 12; 13 in the elastic layer 44; 45 significantly improves the damping characteristics of the entire double section 63. In effect, longitudinal compensation is afforded between the inner profiled section 12; 13 and the outer profiled section 56; 57, particularly when the double section 63 is deformed in a downward direction, in other words when the double section 63 is flexed. This longitudinal compensating motion is not hampered by the terminal arrangement of the elastic layer 44; 45 and this elastic layer 44; 45 simultaneously produces a more pronounced counteracting countering or damping force in the terminal regions of the inner profiled section 12, 13 as the deformation displacement becomes more pronounced.

The complementary double-tube section 63 with the multi-layered, in particular three to six-layered, structure, for the first time offers a core element or core component 39 with favourable elasticity and strength properties, which in turn has a positive effect on the overall behaviour of the running properties of the runner device 1.

As a result of incorporating the described core component 39 or double-tube section 63 described, the elasticity and damping properties of the runner device 1 are also determined to a decisive degree by its core region and the runner device 1 proposed by the invention thereby offers significantly improved selected properties than runner bodies of a conventional structure used for various types of winter sports. The core component 39 with the structure described in detail above, which acts as a flexural bearing, has a surprisingly conducive effect on properties of the runner device 1 and these positive implications were not entirely foreseeable.

Figure 11:
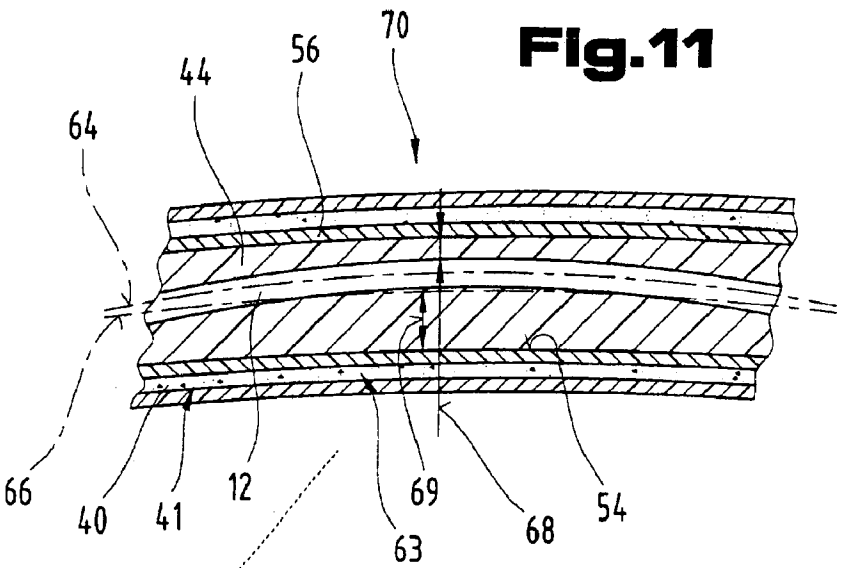
FIG. 11 is a simplified, schematic diagram showing a part-region of the runner device in the mid-region of the integrated double section, viewed in the longitudinal section thereof.
Figure 10:
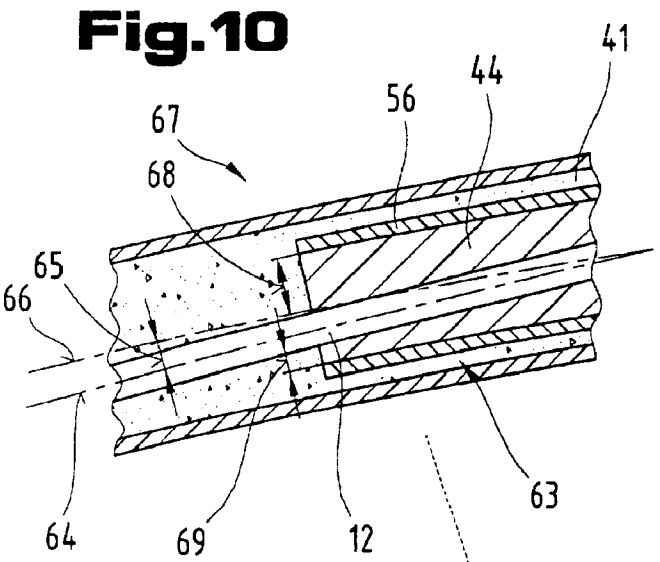
FIG. 10 is a very simplified, schematic diagram, viewed in longitudinal section, of a part-region of a runner device in an end region of the integrated double section.
Figure 12:
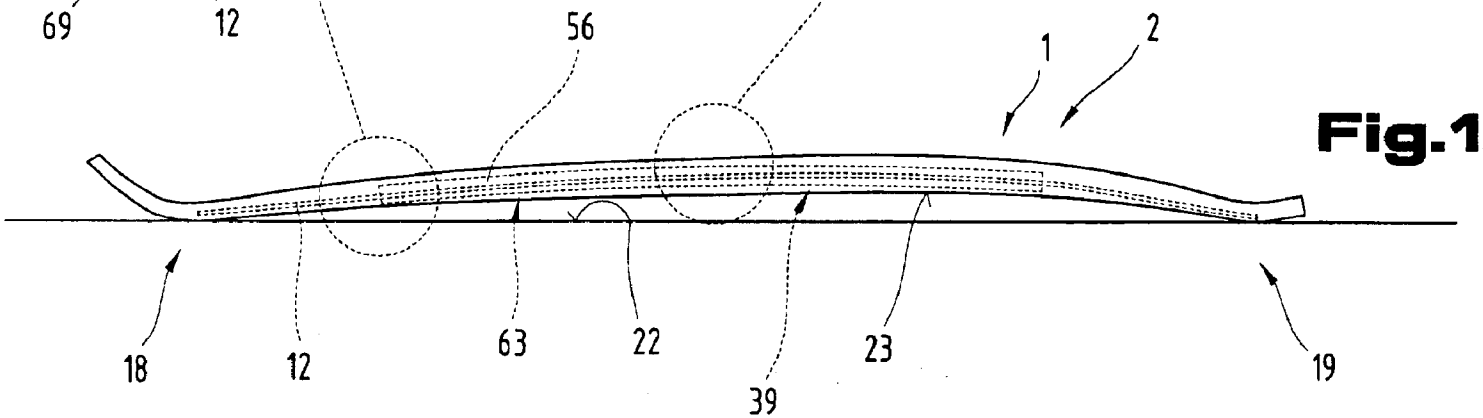
FIG. 12 is a side view of a runner device with the structural features illustrated in FIGS. 10 and 11.

FIGS. 10 to 12 illustrate another embodiment of a runner device 1 as proposed by the invention, the same reference numbers being used for parts already described above. Reference may be made to the explanations given above, the meaning of which may be transposed to this part of the description of same parts bearing the same reference numbers.

In this instance, by contrast with the embodiment described above, the inner profiled section 12; 13 is longer than the outer profiled section 56; 57 enclosing it. The profiled sections 12, 56 or 13; 57 therefore in turn form a sort of double section 63 with an elastic layer 44; 45 between the boundary surfaces directed towards one another. By preference, the two terminal ends of the inner profiled section 12; 13 project beyond the terminal ends of the enclosing outer profiled section 56; 57. Alternatively, only one terminal end of the inner profiled section 12; 13 could project beyond the outer profiled section 56; 57. By preference, the outer profiled section 56; 57 with the intermediate elastic layer 44; 45 is almost pushed onto the inner, central profiled section 12; 13, so that the inner profiled section 12; 13 stands proud on either side of the outer profiled section 56; 57. Both the outer profiled section 56; 57 and the inner profiled section 12; 13 are preferably of an integral or continuous and seamless design, in particular without any transversely extending seams. Consequently, the outer profiled section 56; 57 is able to accommodate the inner profiled section 12; 13 and, in order to enable the inner profiled section 12; 13 to be fully inserted in the outer profiled section 56; 57 in the longitudinal direction, the cross-sectional surface area of the cavity of the outer profiled section 56; 57 is larger than the cross-sectional surface area of the inner profiled section 12; 13 to be introduced into it. In particular, the cross-sectional surface area and/or the cross-sectional width of the cavity of the outer profiled section 56; 57 is significantly larger than the largest corresponding cross-sectional dimension of the inner profiled section 12; 13 to be accommodated. This ensures that an elastic layer 44; 45 of an adequate thickness can be provided in between.

In the embodiment illustrated as an example here, the profiled section 12; 13 is made from solid material and therefore forms a sort of rod or bearing element. The thickness of the profiled section 12; 13 is selected so as to be significantly smaller than the external dimension of the outer profiled section 56; 57 or the corresponding hollow section.

The inner profiled section 12; 13 extends into the contact zones 18, 19 with the underlying flat ground 22 when the runner device 1 is in the unloaded state.

As may be seen particularly clearly from FIGS. 10 and 11, the inner profiled section 12; 13 has a more pronounced longitudinal curvature than the outer profiled section 56; 57. As a result, the inner profiled section 12; 13 may be off-centre, at least relative to one terminal end of the outer profiled section 56; 57. In other words, a longitudinal mid-axis 64 of the inner profiled section 12; 13 at the outlet point is disposed at a distance 65 from the outer profiled section 56; 57, as measured perpendicular to a longitudinal mid-axis 66 of the outer profiled section 56; 57.

Looking at the runner device 1 or the double section 63 from the side, the fact that the longitudinal curvature of the inner profiled section 12; 13 is more pronounced than the longitudinal curvature of the outer profiled section 56; 57 means that in an outlet region 67 of the profiled section 12; 13 from the profiled section 56; 57, a layer thickness 68 of the elastic layer 44; 45 above the profiled section 12; 13 is larger than a layer thickness 69 of the elastic layer 44 on the underside of the profiled section 12; 13.

Likewise, this also means that in a mid-region 70 of the outer profiled section 56; 57, the upper layer thickness 68 of the elastic layer 44; 45 between the top face of the profiled section 12; 13 and the internal face of the profiled section 56; 57 facing it is smaller than the bottom layer thickness 69 of the elastic layer 44; 45 between the underside of the profiled section 12; 13 and the internal surface 54; 55 of the outer profiled section 56; 67 facing it. As a result, a flexural body or double section 63 is obtained, which enables relatively large displacement paths. These relative displacement paths are determined by the compression and expansion paths of the elastic layer 44; 45. In particular, because of the shape and layout of the double section 63, a relatively longer damping path can be obtained in spite of the severely limited availability of space in the structural height of the runner device 11. Above all, the differences in curvature described above enable damping travel of relatively large dimensions to be obtained between the inner profiled section 12; 13 and the outer profiled section 56; 57, at least in one direction of deformation.

The double section 63 is preferably also embedded in an expanded foam core 41 of the runner device 1. This being the case, the expanded foam core 41 and its filler 40 may be of a relatively more compact structure or have harder properties.

The outer profiled section 56; 57 and/or the inner profiled section 12; 13 in this embodiment can also be adapted or adjusted to the space available in the ski body.

In particular, if the inner profiled section 12; 13 has a correspondingly more pronounced longitudinal curvature, the longitudinal mid-axis 64 thereof will intersect the longitudinal mid-axis 66 of the outer profiled section 56; 57 twice.

FIGS. 13 to 16 are plan views of different possible embodiments of the runner device 1 proposed by the invention, the broken lines indicating the shape or contour of the integrated profiled sections 12; 13; 56; 57 or double sections 63.

Figure 14:
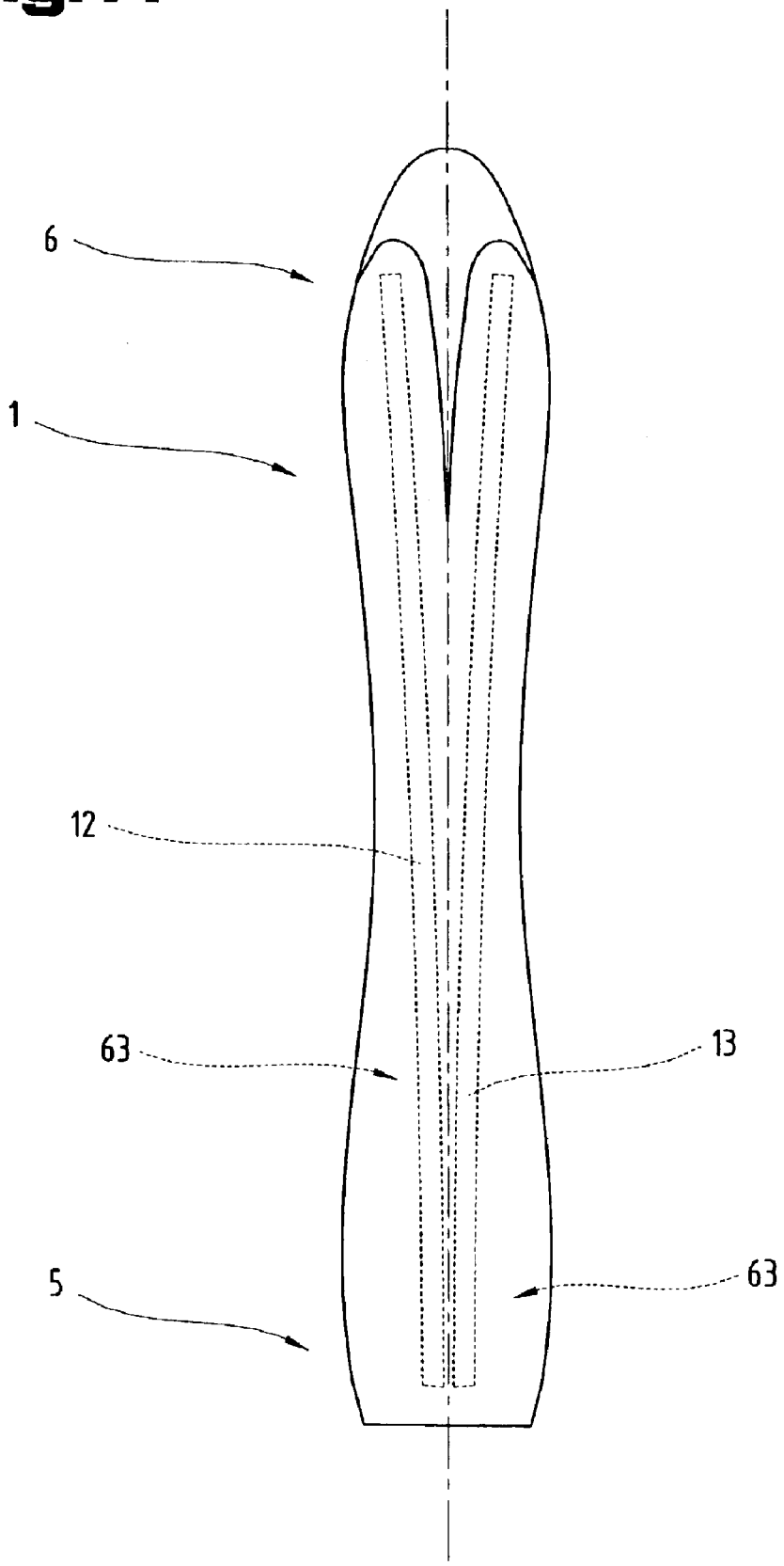
FIG. 14 is a plan view of another embodiment of a runner device with V-shaped moulded or double sections running towards one another.
Figure 15:
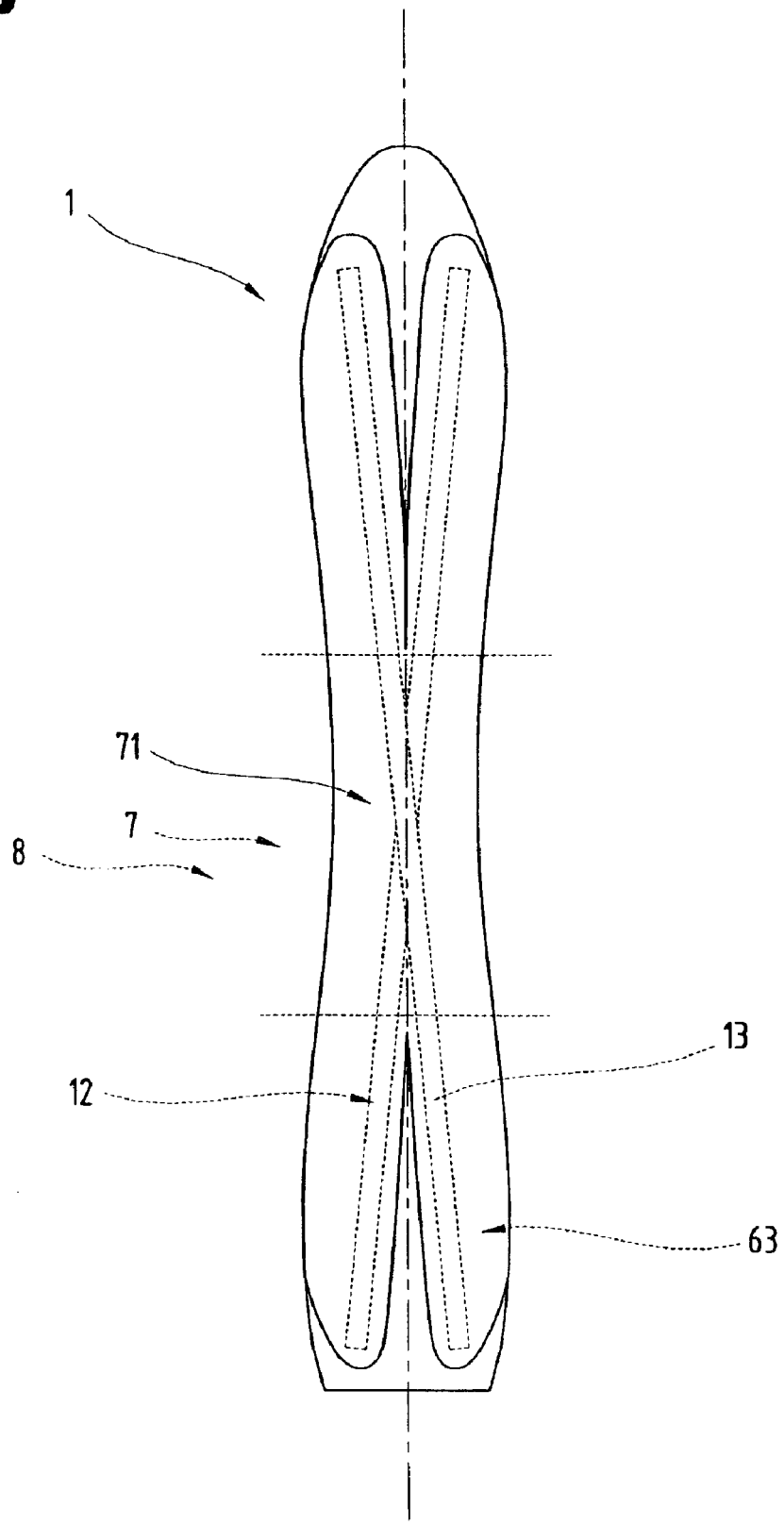
FIG. 15 shows a runner device with moulded or double sections laid out in an X-shaped arrangement.

As illustrated in FIGS. 13 to 15, two adjacent profiled sections 12; 13; 56; 57 or double sections 63 are integrated in the runner device body. In the plan view of the runner device 1 given in FIG. 13, these curve in an arcuate shape. A distance between the adjacent profiled sections 12; 13; 56; 57 in the binding mounting region 8 is smaller than the distance between the profiled sections 12; 13; 56; 57 in the end regions 5, 6 of the runner device 1. In other words, in the binding mounting region 8, the longitudinally curved profiled sections 12; 13; 56; 57 are spaced at the smallest relative distance from one another.

As seen in the plan view onto the runner device 1 shown in FIG. 14, the profiled sections 12; 13; 56; 57 may also be aligned in a V-shaped arrangement and therefore mostly run in a straight line but also have a longitudinal curvature. The imaginary or actual vertex of profiled sections 12; 13; 56; 67 aligned in a V-shaped arrangement relative to one other is disposed either at the tip-end end region 6 or the opposite end region 5 of the runner device 1.

As illustrated in FIG. 15, however, the profiled sections 12; 13; 56; 57 may also be integrated in the runner device 1 in an intersecting arrangement. An intersection point 71 of the profiled sections 12; 13; 56; 57 will preferably lie more or less in the mid-region 7 or in the binding mounting region 8 of the runner device 1. The profiled sections 12; 13; 56; 57 may be adapted accordingly or permanently shaped so as to be better adapted to the cut or lateral shape of the runner device 1.

Figure 16:
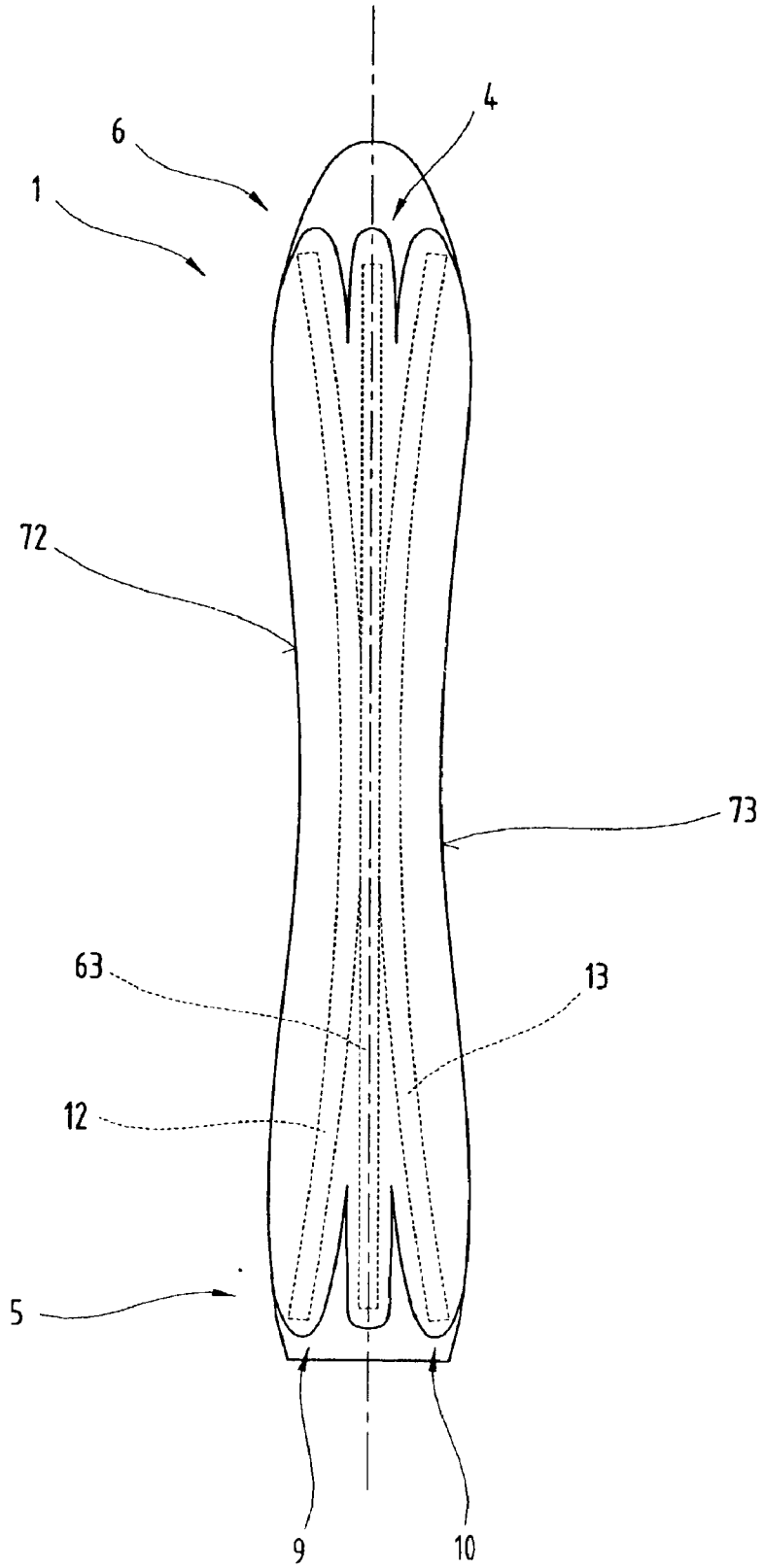
FIG. 16 is a plan view of a runner device with three integrated moulded or double sections.

As illustrated in FIG. 16, several profiled sections 12; 13; 56; 57 or several double sections 63 are placed side by side. In particular, three lengths of section are provided, the middle profiled length running in a substantially straight line, whilst the two adjacent outer profiled lengths conform more or less to the cut of and are shaped more or less to the same design as the closest lying side edge 72, 73 of the runner device 1.

For the sake of good order, it should finally be pointed out that in order to provide a clearer understanding of the structure of the runner device 1, it and its constituent parts have been illustrated out of scale to a certain extent and/or on an enlarged and/or reduced scale.

The tasks underlying the independent inventive solutions can be found in the description. Above all, subject matter relating to the individual embodiments illustrated in FIGS. 1; 2; 3; 4; 5; 6; 7; 8; 9; 10, 11, 12; 13, 14, 15, 16 can be construed as independent solutions proposed by the invention. The tasks and solutions can be found in the detailed descriptions relating to these drawings.

List of Reference Numbers

1 Runner device
2 Ski
3 Top face
4 Contouring
5 End region
6 End region
7 Mid-region
8 Binding mounting region
9 Mound
10 Mound
11 Recess
12 Profiled section
13 Profiled section
14 Raised area
15 Raised area
16 Viewing window
17 Cut-out region
18 Contact zone
19 Contact zone
20 Contact point
21 Contact point
22 Underlying ground
23 Running surface
24 Top layer
25 Running surface lining
26 Longitudinal side wall
27 Longitudinal side wall
28 Steel edge
29 Steel edge
30 Bottom belt
31 Top belt
32 Filler or adhesive layer
33 Anchoring projection
34 Anchoring projection
35 Longitudinal edge
36 Longitudinal edge
37 Longitudinal edge
38 Distance
39 Core component
40 Filler
41 Expanded foam core
42 Hollow section
43 Hollow section
44 Layer
45 Layer
46 Sheath
47 Sheath
49 Height
49 Diameter
50 Structural height
51 Fixing mount
52 Mount
53 Mount
54 Internal surface
55 Internal surface

56 Profiled section
57 Profiled section
58 Lateral web element
59 Lateral web element
60 Inside width
61 Cavity
62 Cavity
63 Double section
64 Longitudinal mid-axis
65 Distance
66 Longitudinal mid-axis
67 Outlet region
68 Layer thickness
69 Layer thickness
70 Mid-region
71 Intersection point
72 Side edge
73 Side edge

What is claimed is:

1. A ski or snowboard comprising several layers disposed between a running surface lining and a top layer contoured to form at least two raised areas extending in a longitudinal direction and defining a recess therebetween, including a top belt of a high-tensile material laying closest to the top layer and a bottom belt of a high-tensile material laying closest to the running surface lining, the layers forming a multi-layer element with a profiled section disposed between the top belt and the bottom belt below each one of the raised areas; the outer surface of the profiled section being embedded in, and completely surrounded by, a layer of an elastic expanded synthetic material that is flexible and elastically resilient relative to the profiled section under pressure; a top face of the ski or snowboard opposite the running surface lining having a contour consisting of the raised areas and recess, the cross-sectional shape or dimension of the profiled sections at least approximately conforming to the raised areas and recess of the top face contour, and the cross-sectional shape or dimension being a factor determining the top face contour.

2. The ski or snowboard of claim 1, wherein the layer of elastic synthetic material is comprised of an elastomeric, expanded synthetic material having a density of 200 kg/cu.m to 400 kg/cu.m.

3. The ski or snowboard of claim 2, wherein the elastomeric, expanded synthetic material is polyurethane foam.

4. The ski or snowboard of claim 1, wherein the at least part-region of the outer surface of the profiled section runs close to the bottom or top belt, the layer of elastic synthetic material being disposed in between.

5. The ski or snowboard of claim 1, wherein the at least part-region of the outer surface of the profiled section is supported on an internal surface of an outer profiled section at least partially enclosing the profiled section, and the layer of elastic synthetic material is inlaid therebetween.

6. The ski or snowboard of claim 5, wherein the outer profiled section has a U-shaped, V-shaped or dish-shaped cross-section and encloses at least an upper outer surface region of the profiled section disposed therebelow.

7. The ski or snowboard of claim 5, wherein the outer profiled section has an elliptical cross-section.

8. The ski or snowboard of claim 5, wherein one of the profiled sections extends continuously into spaced-apart regions of contact of an underside of the ski or snowboard with a level underlying ground when no load is applied thereto, and the other profiled section is shorter than the one profiled section.

9. The ski or snowboard of claim 8, wherein the profiled section extends beyond the ends of the outer profiled section to the regions of contact, and the profiled section is completely uncoupled from the outer profiled section.

10. The ski or snowboard of claim 5, wherein the layer of elastic synthetic material is a spacing web spacing the1 profiled section apart from the outer profiled section, the profiled sections defining at least one cavity therebetween.

11. The ski or snowboard of claim 10, wherein the spacing web is so aligned that the cavity is formed above or below the profiled section bounded by the outer profiled section.

12. The ski or snowboard of claim 10, wherein the spacing web is aligned vertically between the profiled section and the outer profiled section and is so dimensioned that the cavity is formed in at least one of two side regions between the profiled sections.

13. The ski or snowboard of claim 1, wherein the profiled section and the layer of elastic synthetic material forms a multi-layered core of the multi-layer element, the multi-layered core being capable of being pre-fabricated.

14. The ski or snowboard of claim 1, wherein the profiled section is a hollow section with a closed shell surface.

15. The ski or snowboard of claim 14, wherein the hollow section is tubular.

16. The ski or snowboard of claim 15, wherein the tubular profiled section is received in an outer tubular profiled section, the layer of elastic synthetic material being arranged therebetween.

17. The ski or snowboard of claim 1, wherein the elastic synthetic material is an expandable synthetic material forming a core of the multi-layer element.

18. The ski or snowboard of claim 1, wherein the elastic synthetic material is a silicone or rubber material sheathing the profiled section.

19. The ski or snowboard of claim 1, wherein the profiled section decreases in height from a mid-region of the ski or snowboard to the ends thereof, the mid-region forming a mounting region for a binding.

20. A ski or snowboard comprising several layers disposed between a running surface lining and a top layer, including a top belt of a high-tensile material laying closest to the top layer and a bottom belt of a high-tensile material laying closest to the running surface lining, the layers forming a multi-layer element with at least one hollow tubular section with a closed shell surface disposed between the top belt and the bottom belt, the at least one hollow tubular section being received in an outer tubular section which is flattened at the ends thereof and the at least one hollow tubular section being shorter than the outer tubular section; at least a part-region of the outer surface of the at least one hollow tubular section being embedded in a layer of an elastic synthetic material that is flexible and elastically resilient relative to the at least one hollow tubular section under pressure, the layer of elastic synthetic material being arranged between the at least one hollow tubular section and the outer tubular section; a top face of the ski or snowboard opposite the running surface lining having a contour consisting of at least one raised area and recess, the cross-sectional shape or dimension of the at least one hollow tubular section at least approximately conforming to the at least one raised area and recess of the top face contour, and the cross-sectional shape or dimension being a factor determining the top face contour.

21. A ski or snowboard comprising several layers disposed between a running surface lining and a top layer, including a top belt of a high-tensile material laying closest to the top layer and a bottom belt of a high-tensile material laying closest to the running surface lining, the layers forming a multi-layer element with at least one profiled section disposed between the top belt and the bottom belt; at least a part-region of the outer surface of the at least one profiled section being embedded in a layer of an elastic synthetic material that is flexible and elastically resilient relative to the at least one profiled section under pressure, the at least one profiled section directly abutting an underside of the top belt and being spaced apart by the layer of elastic synthetic material from the bottom belt and lower layers of the multi-layer element; a top face of the ski or snowboard opposite the running surface lining having a contour consisting of at least one raised area and recess, the cross-sectional shape or dimension of the at least one hollow tubular section at least approximately conforming to the at least one raised area and recess of the top face contour, and the cross-sectional shape or dimension being a factor determining the top face contour.

22. A ski or snowboard comprising several layers disposed between a running surface lining and a top layer, including a top belt of a high-tensile material laying closest to the top layer and a bottom belt of a high-tensile material laying closest to the running surface lining, the layers forming a multi-layer element with at least one profiled section disposed between the top belt and the bottom belt, the cross-sectional width of the at least one profiled section being approximately 10% to 40% of the width of the ski or snowboard; at least a part-region of the outer surface of the at least one profiled section being embedded in a layer of an elastic synthetic material that is flexible and elastically resilient relative to the at least one profiled section under pressure; a top face of the ski or snowboard opposite the running surface lining having a contour consisting of at least one raised area and recess, the cross-sectional shape or dimension of the at least one hollow tubular section at least approximately conforming to the at least one raised area and recess of the top face contour, and the cross-sectional shape or dimension being a factor determining the top face contour.

23. The ski or snowboard of claim 22, wherein the transverse extension of the layer of elastic synthetic material is approximately 10% to 40% of the width of the ski or snowboard.

* * * * *